US012227815B2

(12) United States Patent
Yuga et al.

(10) Patent No.: US 12,227,815 B2
(45) Date of Patent: Feb. 18, 2025

(54) SEAMLESS STEEL PIPE HAVING DESIRABLE SULFURIC ACID DEW-POINT CORROSION RESISTANCE, AND METHOD FOR MANUFACTURING SAME

(71) Applicant: JFE Steel Corporation, Tokyo (JP)

(72) Inventors: Masao Yuga, Tokyo (JP); Hiroyuki Takai, Tokyo (JP); Yasumasa Takemura, Tokyo (JP); Mitsuhiro Okatsu, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 493 days.

(21) Appl. No.: 17/623,919

(22) PCT Filed: Jun. 12, 2020

(86) PCT No.: PCT/JP2020/023144
§ 371 (c)(1),
(2) Date: Dec. 30, 2021

(87) PCT Pub. No.: WO2021/005960
PCT Pub. Date: Jan. 14, 2021

(65) Prior Publication Data

US 2022/0411890 A1 Dec. 29, 2022

(30) Foreign Application Priority Data

Jul. 9, 2019 (JP) ..... 2019-127602

(51) Int. Cl.
*C21D 9/08* (2006.01)
*C21D 1/28* (2006.01)
(Continued)

(52) U.S. Cl.
CPC ..... *C21D 9/085* (2013.01); *C21D 1/28* (2013.01); *C21D 6/004* (2013.01); *C21D 6/005* (2013.01);
(Continued)

(58) Field of Classification Search
CPC ..... C21D 9/085; C21D 1/28; C21D 6/004; C21D 6/005; C21D 6/008; C21D 8/105;
(Continued)

(56) References Cited

U.S. PATENT DOCUMENTS 6,171,547 B1 1/2001 Sagara et al.
7,731,896 B2 6/2010 Usami et al.
(Continued)

FOREIGN PATENT DOCUMENTS

CN 1386886 A * 12/2002
CN 1386888 A 12/2002
(Continued)

OTHER PUBLICATIONS

JPS5569246A (Year: 1980).*
(Continued)

*Primary Examiner* — Ricardo D Morales
(74) *Attorney, Agent, or Firm* — Buchanan Ingersoll & Rooney PC

(57) ABSTRACT

A seamless steel pipe of the present invention is a seamless steel pipe having a composition that includes, in mass %, C: 0.02 to 0.12%, Si: 0.010 to 1.00%, Mn: 0.10 to 2.00%, P: 0.050% or less, S: 0.004% or less, Al: 0.010 to 0.100%, Cu: 0.03 to 0.80%, Ni: 0.02 to 0.50%, Cr: 0.55 to 1.00%, Sb: 0.005 to 0.20%, and the balance Fe and incidental impurities, and satisfying the following formula (1), $$1.7\times Cu^*+11\times Cr^*+3.8\times Sb^*\geq 13.5 \quad (1),$$

where Cu*, Cr*, and Sb* represent average concentrations of Cu, Cr, and Sb, respectively, in mass %, as measured in a region 0.5 to 2.0 mm away from an outer surface of the steel pipe, the seamless steel pipe having a yield strength of 230 MPa or more, and a tensile strength of 380 MPa or more.

20 Claims, 4 Drawing Sheets

(51) Int. Cl.

| | |
|---|---|
| ***C21D 6/00*** | (2006.01) |
| ***C21D 8/10*** | (2006.01) |
| ***C22C 38/00*** | (2006.01) |
| ***C22C 38/02*** | (2006.01) |
| ***C22C 38/06*** | (2006.01) |
| ***C22C 38/42*** | (2006.01) |
| ***C22C 38/44*** | (2006.01) |
| ***C22C 38/58*** | (2006.01) |

(52) U.S. Cl.
CPC ..... *C21D 6/008* (2013.01); *C21D 8/105* (2013.01); *C22C 38/002* (2013.01); *C22C 38/008* (2013.01); *C22C 38/02* (2013.01); *C22C 38/06* (2013.01); *C22C 38/42* (2013.01); *C22C 38/44* (2013.01); *C22C 38/58* (2013.01)

(58) Field of Classification Search
CPC ..... C22C 38/002; C22C 38/008; C22C 38/02; C22C 38/06; C22C 38/42; C22C 38/44; C22C 38/58
See application file for complete search history.

(56) References Cited

U.S. PATENT DOCUMENTS

| | | | | |
|---|---|---|---|---|
| 2012/0042992 | A1 | 2/2012 | Kondo et al. | |
| 2017/0114425 | A1 | 4/2017 | Katagiri et al. | |
| 2018/0209007 | A1* | 7/2018 | Sugiura | C22C 38/44 |

FOREIGN PATENT DOCUMENTS

| | | | | | |
|---|---|---|---|---|---|
| CN | 1490427 | A | | 4/2004 | |
| CN | 102719747 | A | | 10/2012 | |
| CN | 105937010 | A | | 8/2016 | |
| CN | 10592589 | A | | 9/2016 | |
| CN | 106414784 | A | | 2/2017 | |
| CN | 107709593 | A | | 2/2018 | |
| CN | 107904493 | A | | 4/2018 | |
| CN | 108660384 | A | | 10/2018 | |
| CN | 109082591 | A1 | | 12/2018 | |
| CN | 109563595 | A | | 4/2019 | |
| CN | 109642283 | A | | 4/2019 | |
| EP | 2272994 | B1 | * | 11/2014 | C21D 8/0226 |
| JP | S5569246 | A | * | 5/1980 | C22C 38/00 |
| JP | 08120403 | A | | 5/1996 | |
| JP | H08120403 | A | * | 5/1996 | C22C 38/00 |
| JP | 2002047538 | A | | 2/2002 | |
| JP | 2003213367 | A | | 7/2003 | |
| JP | 2004360064 | A | | 12/2004 | |
| JP | 2006118011 | A | | 5/2006 | |
| JP | 2007262558 | A | | 10/2007 | |
| JP | 2011179022 | A | | 9/2011 | |
| JP | 2017186650 | A | | 10/2017 | |
| WO | 2018001043 | A1 | | 1/2018 | |

OTHER PUBLICATIONS

JPH08120403A (Year: 1996).*
Chinese Office Action for Chinese Application No. 202080049959.8, dated Oct. 13, 2022, with Concise Statement of Relevance of Office Action, 6 pages.
Extended European Seach Report for European Application No. 20835991.9, dated Dec. 6, 2022, 8 pages.
Chinese Office Action for Chinese Application No. 202080049959.8, dated Apr. 21, 2023, with Concise Statement of Relevance of Office Action, 6 pages.
Chinese Office Action for Chinese Application No. 202080049959.8, dated Jan. 20, 2023, with Concise Statement of Relevance of Office Action, 6 pages.
Chinese Office Action with Search Report for Chinese Application No. 202080049959.8, dated Apr. 26, 2022, 11 pages.
International Search Report and Written Opinion for International Application No. PCT/JP2020/023144, dated Aug. 18, 2020, 5 pages.

* cited by examiner

[FIG. 1]
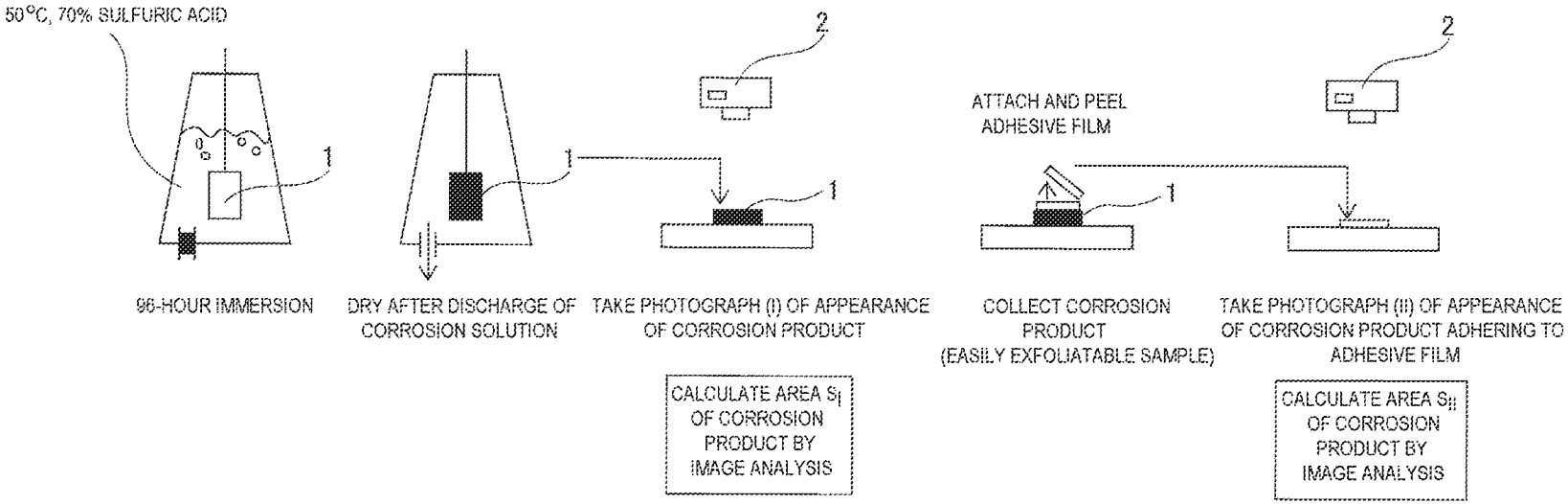

[FIG. 2]
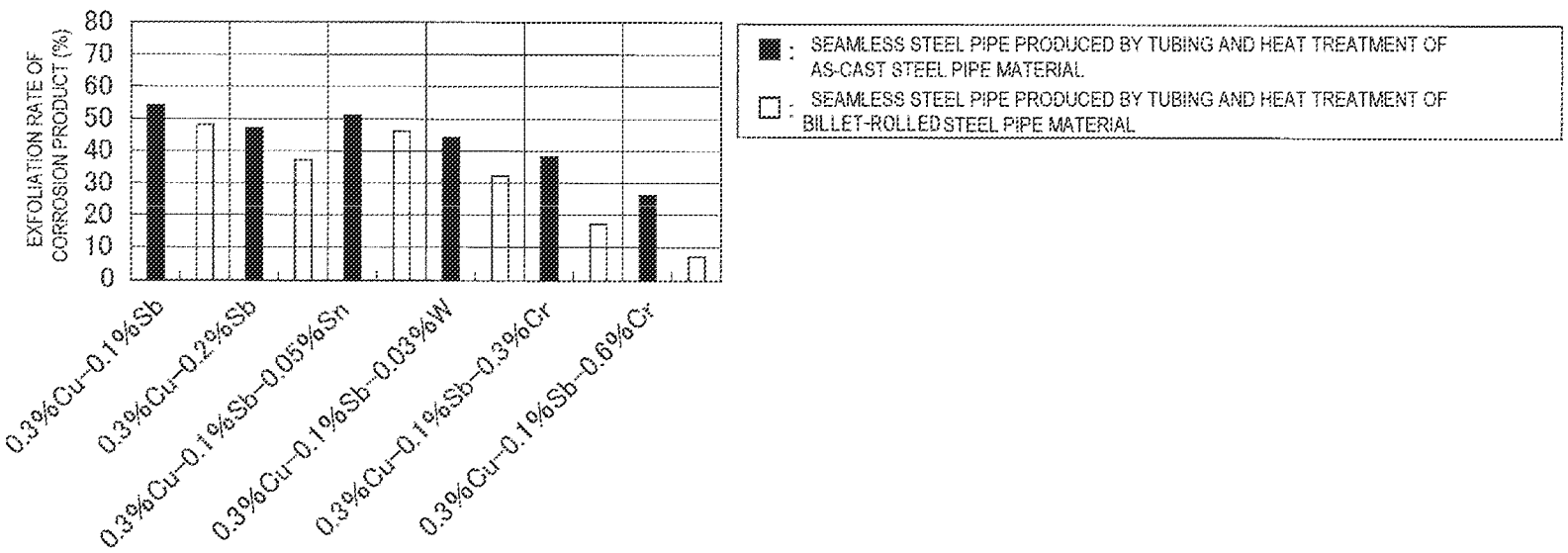

[FIG. 3]
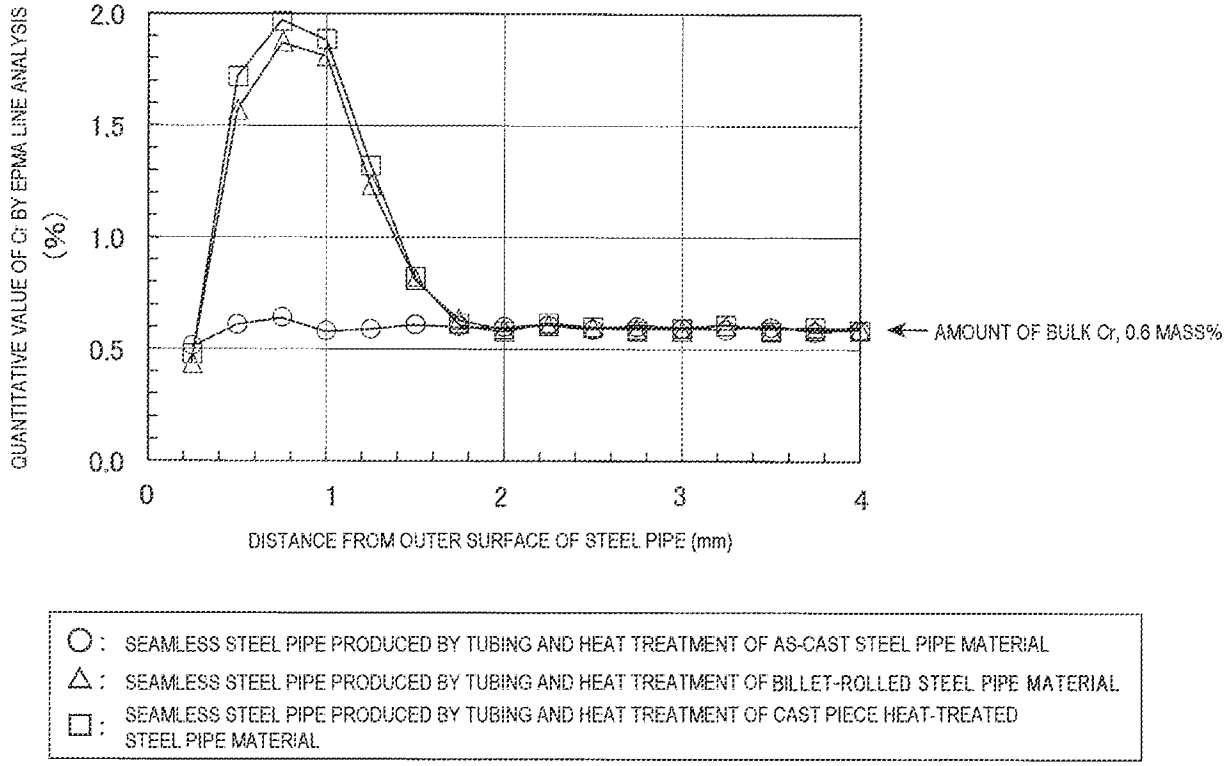

[FIG. 4]
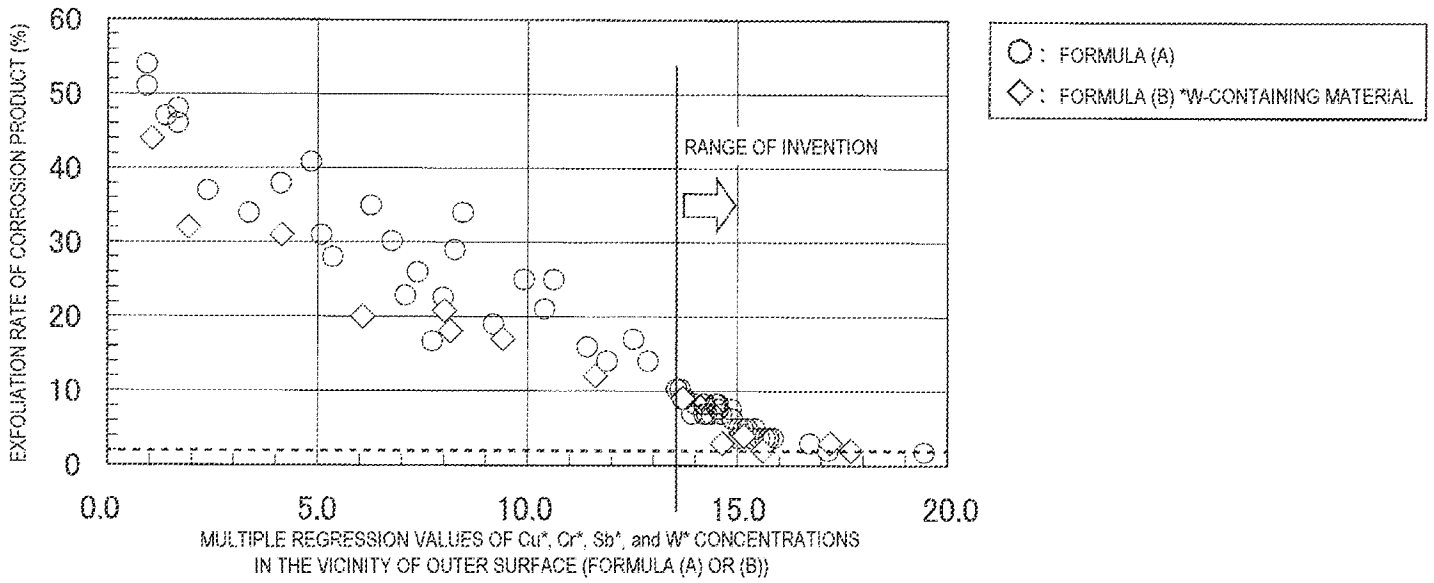

SEAMLESS STEEL PIPE HAVING DESIRABLE SULFURIC ACID DEW-POINT CORROSION RESISTANCE, AND METHOD FOR MANUFACTURING SAME

CROSS REFERENCE TO RELATED APPLICATIONS

This is the U.S. National Phase application of PCT/JP2020/023144, filed Jun. 12, 2020, which claims priority to Japanese Patent Application No. 2019-127602, filed Jul. 9, 2019, the disclosures of these applications being incorporated herein by reference in their entireties for all purposes.

FIELD OF THE INVENTION

The present invention relates to a seamless steel pipe having desirable sulfuric acid dew-point corrosion resistance, and to a method for manufacturing the same. Specifically, the present invention relates to a seamless steel pipe suitable for piping in a sulfuric acid dew-point corrosive environment created by the combustion exhaust gas of boilers, gasification melting furnaces, and the like, particularly, a seamless steel pipe for piping useful for preventing scattering of corrosion products produced by sulfuric acid dew-point corrosion, and that exhibits desirable sulfuric acid dew-point corrosion resistance in a heat recovery steam generator, and to a method for manufacturing such a seamless steel pipe.

BACKGROUND OF THE INVENTION

In the gas flue of boilers, thermal power plants, and other such devices or facilities that burn sulfur-containing fuel such as heavy oil and coal, the sulfur oxide contained in exhaust gas turns into sulfuric acid as it condenses with a temperature drop. This causes severe corrosion called sulfuric acid dew-point corrosion. To be more specific, in a seamless steel pipe used for heat recovery pipes of heat recovery steam generators, sulfuric acid dew-point corrosion can lead to accidents by reducing the pipe lifetime or damaging pipes. There is also a possibility of causing exfoliation of corrosion products produced by sulfuric acid dew-point corrosion, and the corrosion products may affect the surrounding environment when scattered into the surroundings through an exhaust duct of a boiler.

Various proposals have been made to reduce the sulfuric acid dew-point corrosion itself. For example, PTL 1 discloses a steel containing 0.001 to 0.2 mass % carbon and to which appropriate amounts of Si, Mn, P, and S, and, additionally, Cu: 0.1 to 1 mass %, Mo: 0.001 to 1 mass %, and Sb: 0.01 to 0.2 mass % are added to obtain a sulfuric acid dew-point corrosion resistant steel containing controlled amounts of Sb, C, and Mo satisfying a specific relationship.

PTL 2 discloses adding W, Sn, and Cr to a steel containing C: 0.01 to 0.12 mass %, Cu: 0.03 to 1.0 mass %, and Sb: 0.002 to 0.7 mass %, and controlling the C, Sb, and W contents to satisfy a specific relationship, and provide a sulfuric acid dew-point corrosion resistant steel having improved sulfuric acid dew-point corrosion resistance and hydrochloric acid dew-point corrosion resistance.

Patent Literature

PTL 1: JP-A-2003-213367
PTL 2: JP-A-2007-262558

SUMMARY OF THE INVENTION

The techniques disclosed in PTL 1 and PTL 2 are intended to lower the sulfuric acid dew-point corrosion rate or hydrochloric acid dew-point corrosion rate, and are probably effective at inhibiting formation of sulfuric acid dew-point corrosion products, which cause problems in applications such as in heat recovery steam generators. It is, however, difficult to sufficiently inhibit sulfuric acid dew-point corrosion in a more severe environment with a sulfuric acid concentration as high as 70 mass %. PTL 1 and PTL 2 are also totally silent as to exfoliation of corrosion products produced in such an environment. These related art documents also do not contain detailed descriptions related to manufacture of a seamless steel pipe suited for piping in heat recovery steam generators, and do not provide optimum conditions that ensure both sulfuric acid dew-point corrosion resistance and manufacturability of a seamless steel pipe.

Aspects of the present invention were made under these circumstances, and it is an object according to aspects of the present invention to provide a seamless steel pipe having desirable sulfuric acid dew-point corrosion resistance, and that is suited for piping in a sulfuric acid dew-point corrosive environment such as in a heat recovery steam generator while being desirably manufacturable.

Another object according to aspects of the present invention is to provide a suitable method of manufacture of the seamless steel pipe.

In order to find a solution to the foregoing problems, the present inventors conducted intensive studies of exfoliation of corrosion products produced in a sulfuric acid dew-point corrosive environment. Specifically, a seamless steel pipe measuring 138.9 mm in outer diameter and 10.8 mm in wall thickness was produced from a steel pipe material prepared by appropriately adding Sn, W, and Cr to a base steel pipe material of a composition containing, in mass %, basic chemical components C: 0.04%, Si: 0.2%, Mn: 1.4%, and Al: 0.02%, and, additionally, Cu and Sb added as elements that are considered effective for acid resistance. The seamless steel pipe was subjected to a normalizing heat treatment at a normalizing temperature of 950° C., and a corrosion test specimen was taken from the outer surface side of the steel pipe.

Specifically, a corrosion test specimen (30 mm in length× 20 mm in width×5 mm in thickness) including an outer surface of steel pipe was taken from the outer surface side of steel pipe, and a surface corresponding to the outer surface side of steel pipe was ground by 0.5 mm to remove unwanted components such as scale. The specimen was then subjected to a sulfuric acid dew-point corrosion test using the procedures schematically represented in FIG. 1, and exfoliation of corrosion products produced in the corrosion test was evaluated.

As shown in FIG. 1, a sulfuric acid aqueous solution that had been adjusted to a concentration of 70 mass % was poured into a container, and the corrosion test specimen (test specimen 1 in FIG. 1) was immersed in the solution after the solution was heated and maintained at 50° C. with an external thermostat bath. The specimen was immersed for 96 hours. After 96-hour immersion, the sulfuric acid aqueous solution was discharged from the container, and the corrosion test specimen 1 was dried, and carefully taken out of the container. On a table, the corrosion test specimen 1 was photographed with a digital camera 2 to capture an image of corrosion products produced on the specimen surface. The photograph was taken on the outer surface side of steel pipe from which the corrosion test specimen was prepared. After suitable image processing and analysis (using ImageJ software available from NIH), the area $S_I$ ($mm^2$) of corrosion products was calculated from the captured image. After calculation, a transparent adhesive film (Cellotape®, part number CT-24, 24 mm width, available from NICHIBAN) was attached to the captured surface of the corrosion test specimen 1, and the film was peeled to collect easily exfoliatable samples of corrosion products on the adhesive surface of the adhesive film. Images of the corrosion products on the adhesive surface of the adhesive film were captured with digital camera 2, and the area of the corrosion products attached to the adhesive surface of the adhesive film was calculated by image analysis to find the area $S_{II}$ ($mm^2$) of the corrosion products exfoliated from the corrosion test specimen. The percentage of the area ($S_{II}$) of the corrosion products exfoliated from the corrosion test specimen relative to the area ($S_I$) of the corrosion products occurring on the corrosion test specimen surface was then calculated as the exfoliation rate of corrosion products (%), as follows.

$$[(S_{II}/S_I)\times 100]$$

FIG. 2 shows the result of the comparison of the exfoliation rate of corrosion products after the sulfuric acid dew-point corrosion test conducted for seamless steel pipes of different Cu, Sb, Sn, W, and Cr contents used for the experiment. As shown in FIG. 2, the exfoliation rate of corrosion products of the base steel pipe material ("0.3%Cu-0.1%Sb" material in FIG. 2) prepared by adding Cu: 0.3% and Sb: 0.1% to the basic chemical components (0.04%C-0.2%Si-1.4%Mn-0.02%Al) was not greatly different from that of the more Sb rich "0.3%Cu-0.2%Sb" material or the Sn-containing "0.3%Cu-0.1%Sb-0.05%Sn" material. The exfoliation rate of corrosion products improved in the "0.3%Cu-0.1%Sb-0.03%W" material prepared by adding W to the base steel pipe material, and in the "0.3%Cu-0.1%Sb-0.3%Cr" material prepared by adding Cr to the base steel pipe material. The "0.3%Cu-0.1%Sb-0.6%Cr" material with an increased Cr content had an exfoliation rate of corrosion products about half of that of the base steel pipe material ("0.3%Cu-0.1%Sb" material).

It was also found that the exfoliation rate of corrosion products depends on the method of manufacture of steel pipe material, even when the composition is the same. Specifically, the exfoliation rate of corrosion products was more desirable in a seamless steel pipe manufactured by tubing and heat treatment of a steel pipe material (hereinafter, referred to also as "billet-rolled steel pipe material") of a circular cross section produced by heating and hot rolling after continuous casting of a steel from a converter into a cast piece of a rectangular cross section than in a seamless steel pipe manufactured by tubing and heat treatment of a steel pipe material (hereinafter, referred to also as "as-cast steel pipe material") obtained by continuous casting of a steel from a converter directly into a cast piece of a circular cross section.

The present inventors conducted further studies to elucidate the reason why different steel pipe materials (as-cast steel pipe material, billet-rolled steel pipe material) have different exfoliation rates of corrosion products. The studies revealed that the difference is due to the difference in the enrichment of the alloy elements in the outer surface of a seamless steel pipe. Specifically, from a seamless steel pipe of the "0.3%Cu-0.1%Sb-0.6%Cr" material used for the exfoliation rate measurement of corrosion products, a sample was taken from a portion adjacent the region from which the corrosion test specimen was taken, and a cross section orthogonal to the longitudinal direction of the steel pipe was polished to a mirror finish. The sample was then subjected to a quantitative line analysis for the measurement of Cr, using an electron probe micro analyzer (EPMA). EPMA was performed at an accelerating voltage of 20 kV and a beam current of 0.5 μA with a beam size of 10 μm, and the sample was measured in a 4-mm region lying on the outer surface side of steel pipe sample toward the center in the wall thickness of the sample. The measured value was converted into Cr concentration (mass %) using a standard curve created in advance from the characteristic X-ray intensity of Cr—K shell excitation.

FIG. 3 shows the results of EPMA line analysis comparing a sample taken from a seamless steel pipe produced by tubing and heat treatment of an as-cast steel pipe material, and a sample taken from a seamless steel pipe produced by tubing and heat treatment of a billet-rolled steel pipe material. As shown in FIG. 3, the sample taken from a seamless steel pipe produced by tubing and heat treatment of the as-cast steel pipe material had almost the same Cr concentration throughout the 4-mm outer surface region toward the center of the wall thickness of the steel pipe. In contrast, the sample taken from a seamless steel pipe produced by tubing and heat treatment of the billet-rolled steel pipe material showed an increase of Cr concentration in a region within about 1 mm from the outer surface toward the center of the wall thickness of the steel pipe. For comparison, FIG. 3 also shows the result of EPMA measurement for a sample taken from a seamless steel pipe produced by tubing and heat treatment of a stock as-cast steel pipe material after a heat treatment simulating the heat retention of the hot rolling of a billet-rolled steel pipe material, specifically, a heat treatment simulating the heat of the hot rolling that produces a billet-rolled steel pipe material of a circular cross section from a cast piece having a rectangular cross section. In contrast to the as-cast steel pipe material, the sample taken from a seamless steel pipe by tubing and heat treatment of a steel pipe material (hereinafter, referred to also as "cast-piece heat-treated steel pipe material") subjected to the same heat treatment that produces a billet-rolled steel pipe material from a cast piece having a rectangular cross section had a Cr concentration that increased in the same fashion as in the sample taken from a seamless steel pipe produced by tubing and heat treatment of a billet-rolled steel pipe material.

The present inventors carried out the same EPMA measurement also for alloy elements other than Cr. Steels of widely varying alloy element contents were made, and test seamless steel pipes were produced from steel pipe materials produced by using different methods. By using these seamless steel pipes, the present inventors conducted a thorough investigation of a relationship between enrichment of alloy elements below the outer surface of the seamless steel pipe, and the exfoliation rate of corrosion products determined by a sulfuric acid dew-point corrosion test. The alloy elements that influence the exfoliation rate of corrosion products were narrowed down to two groups of elements: Cu, Cr, and Sb, and Cu, Cr, and Sb plus W. The values calculated from the regression formulae below were plotted against the exfoliation rate of corrosion products, as shown in FIG. 4. In the formulae, Cu* Cr*, Sb*, and W* represent the average concentrations of Cu, Cr, Sb, and W, respectively, in mass %, as measured by EPMA in a region 0.5 to 2.0 mm below the outer surface of the seamless steel pipe.

Regression Formula for Cu, Cr, and Sb without W $$1.7\times Cu^*+11\times Cr^*+3.8\times Sb^* \quad (A)$$

Regression Formula for Cu, Cr, and Sb with W $$1.7\times Cu^*+11\times Cr^*+3.8\times Sb^*+5.2\times W^* \quad (B)$$

It was found that the values calculated from formulae (A) and (B) need to be 13.5 or more for the exfoliation rate of corrosion products to be 10% or less, as shown in FIG. 4.

Aspects of the present invention were completed on the basis of these findings, and are as follows.

[1] A seamless steel pipe having desirable sulfuric acid dew-point corrosion resistance, the seamless steel pipe having a composition that includes, in mass %, C: 0.02 to 0.12%, Si: 0.010 to 1.00%, Mn: 0.10 to 2.00%, P: 0.050% or less, S: 0.004% or less, Al: 0.010 to 0.100%, Cu: 0.03 to 0.80%, Ni: 0.02 to 0.50%, Cr: 0.55 to 1.00%, Sb: 0.005 to 0.20%, and the balance Fe and incidental impurities, and satisfying the following formula (1), $$1.7\times Cu^*+11\times Cr^*+3.8\times Sb^*13.5 \quad (1),$$

where Cu*, Cr*, and Sb* represent average concentrations of Cu, Cr, and Sb, respectively, in mass %, as measured in a region 0.5 to 2.0 mm away from an outer surface of the steel pipe toward the center of the wall thickness of the steel pipe, the seamless steel pipe having a yield strength of 230 MPa or more, and a tensile strength of 380 MPa or more.

[2] A seamless steel pipe having desirable sulfuric acid dew-point corrosion resistance, the seamless steel pipe having a composition that includes, in mass %, C: 0.02 to 0.12%, Si: 0.010 to 1.00%, Mn: 0.10 to 2.00%, P: 0.050% or less, S: 0.004% or less, Al: 0.010 to 0.100%, Cu: 0.03 to 0.80%, Ni: 0.02 to 0.50%, Cr: 0.55 to 1.00%, Sb: 0.005 to 0.20%, W: 0.003 to 0.040%, and the balance Fe and incidental impurities, and satisfying the following formula (2), $$1.7\times Cu^*+11\times Cr^*+3.8\times Sb^*+5.2\times W^*13.5 \quad (2),$$

where Cu*, Cr*, Sb*, and W* represent average concentrations of Cu, Cr, Sb, and W, respectively, in mass %, as measured in a region 0.5 to 2.0 mm away from an outer surface of the steel pipe toward the center of the wall thickness of the steel pipe, the seamless steel pipe having a yield strength of 230 MPa or more, and a tensile strength of 380 MPa or more.

[3] The seamless steel pipe having desirable sulfuric acid dew-point corrosion resistance according to [1] or [2], wherein the composition further includes, in mass %, Sn: 0.005 to 0.5%.

[4] A method for manufacturing the seamless steel pipe having desirable sulfuric acid dew-point corrosion resistance of any one of [1] to [3], the method including:

casting a steel of said composition into a cast piece of a rectangular cross section;

heating the cast piece of a rectangular cross section to a heating temperature in a temperature region of 1,000 to 1,200° C., hot rolling the heated cast piece into a steel pipe material of a circular cross section, and cooling the steel pipe material;

heating the cooled steel pipe material to 1,100 to 1,300° C., hot rolling the heated steel pipe material at 800° C. or more into a seamless steel pipe of a predetermined shape, and cooling the seamless steel pipe; and heating the seamless steel pipe at a normalizing temperature of 850 to 1,050° C. in a normalizing heat treatment.

[5] The method according to [4], wherein the cast piece of a rectangular cross section is heated for at least 1.5 hours in a range of from 900° C. to the heating temperature in the temperature region of 1,000 to 1,200° C.

[6] A method for manufacturing the seamless steel pipe having desirable sulfuric acid dew-point corrosion resistance of any one of [1] to [3], the method including:

casting a steel of said composition into a cast piece of a circular cross section;

heating the cast piece of a circular cross section to a heating temperature in a temperature region of 1,000 to 1,200° C. to obtain a steel pipe material, and cooling the steel pipe material;

heating the cooled steel pipe material to 1,100 to 1,300° C., hot rolling the heated steel pipe material at 800° C. or more into a seamless steel pipe of a predetermined shape, and cooling the seamless steel pipe; and heating the seamless steel pipe at a normalizing temperature of 850 to 1,050° C. in a normalizing heat treatment.

[7] The method according to [6], wherein the cast piece of a circular cross section is heated for at least 1.5 hours in a range of from 900° C. to the heating temperature in the temperature region of 1,000 to 1,200° C.

In accordance with aspects of the present invention, "desirable sulfuric acid dew-point corrosion resistance" means that the exfoliation rate of corrosion product is 10% or less as measured when a corrosion test specimen taken from the outer surface of a seamless steel pipe is immersed for 96 hours in a 70 mass % sulfuric acid aqueous solution heated and maintained at 50° C.

Aspects of the present invention can provide a seamless steel pipe having desirable sulfuric acid dew-point corrosion resistance, and that is suited for piping in a sulfuric acid dew-point corrosive environment such as in a heat recovery steam generator while being desirably manufacturable. Aspects of the present invention can also provide a suitable method of manufacture of the seamless steel pipe.

A seamless steel pipe according to aspects of the present invention has desirable sulfuric acid dew-point corrosion resistance, and can effectively reduce exfoliation of corrosion products produced in a severe environment with a sulfuric acid concentration as high as 70 mass %, such as in a heat recovery steam generator. A seamless steel pipe according to aspects of the present invention has a predetermined yield strength and tensile strength, and is suited for piping. A seamless steel pipe according to aspects of the present invention has desirable manufacturability because of the effect to desirably reduce defects produced in the manufacturing process.

BRIEF DESCRIPTION OF THE DRAWINGS

FIG. 1 is a schematic diagram describing a method of measurement of the exfoliation rate of corrosion products.

FIG. 2 is a graph representing the result of the investigation of the exfoliation rate of corrosion products for test seamless steel pipes of different Cu, Sb, Sn, W, and Cr contents.

FIG. 3 is a graph representing the results of EPMA line analyses conducted for a 4-mm outer surface region of seamless steel pipes produced from different steel pipe materials.

FIG. 4 is a graph representing a correlation between the exfoliation rate of corrosion products, and the regression formulae of Cu, Cr, Sb, and W concentrations (Cu*, Cr*, Sb*, W*) in the vicinity of the outer surface of a seamless steel pipe.

DETAILED DESCRIPTION OF EMBODIMENTS OF THE INVENTION

Embodiments of the present invention are described below in detail.

First, the reasons for limiting the composition of a seamless steel pipe having desirable sulfuric acid dew-point corrosion resistance according to aspects of the present invention are described below. As used herein, "%" used as a unit of the content of a component means "mass %", unless otherwise specifically stated. A seamless steel pipe having desirable sulfuric acid dew-point corrosion resistance according to aspects of the present invention will also be referred to simply as "seamless steel pipe according to aspects of the present invention".

C: 0.02 to 0.12%

C is an element that increases steel strength. In accordance with aspects of the present invention, a C content of 0.02% or more is needed to satisfy the required yield strength and tensile strength, particularly when the seamless steel pipe is used for piping. For this reason, the C content is 0.02% or more. The C content is preferably 0.021% or more, more preferably 0.022% or more. A C content of more than 0.12% has adverse effects on high-temperature hot ductility. Specifically, a C content of more than 0.12% causes surface defects during hot rolling of a seamless steel pipe. For this reason, the upper limit of C content is 0.12%. For prevention of surface defects, the C content is preferably 0.08% or less, more preferably 0.04% or less.

Si: 0.010 to 1.00%

Si is an element that acts as a deoxidizing agent, and increases steel strength by forming a solid solution in steel. In accordance with aspects of the present invention, a Si content of 0.010% or more is needed to satisfy the required yield strength and tensile strength, particularly when the seamless steel pipe is used for piping. For this reason, the Si content is 0.010% or more. The Si content is preferably 0.05% or more, more preferably 0.20% or more. A Si content of more than 1.00% has adverse effects on high-temperature hot ductility. For this reason, the upper limit of Si content is 1.00%. The Si content is preferably 0.80% or less, more preferably 0.60% or less.

Mn: 0.10 to 2.00%

Mn is an element that increases steel strength by improving hardenability. In accordance with aspects of the present invention, a Mn content of 0.10% or more is needed to satisfy the required yield strength and tensile strength, particularly when the seamless steel pipe is used for piping. For this reason, the Mn content is 0.10% or more. The Mn content is preferably 0.50% or more, more preferably 1.10% or more. A Mn content of more than 2.00% causes severe centerline segregation during continuous casting, and leads to internal defects at the time of piercing during hot rolling of a seamless steel pipe. For this reason, the upper limit of Mn content is 2.00%. The Mn content is preferably 1.80% or less, more preferably 1.40% or less.

P: 0.050% or Less

P causes serious centerline segregation during continuous casting, and leads to internal defects at the time of piercing during hot rolling of a seamless steel pipe. For this reason, it is preferable in accordance with aspects of the present invention that the P content be reduced as much as possible. However, a P content of at most 0.050% is acceptable. For this reason, the P content is 0.050% or less. The P content is preferably 0.030% or less, more preferably 0.015% or less. The lower limit of P content is not particularly limited. However, the preferred lower limit of P content is about 0.004% because excessive dephosphorization leads to increase of manufacturing cost.

S: 0.004% or Less

S also causes serious centerline segregation during continuous casting, and leads to internal defects at the time of piercing during hot rolling of a seamless steel pipe. For this reason, it is desirable in accordance with aspects of the present invention to reduce the S content as much as possible. However, a S content of at most 0.004% is acceptable. For this reason, the S content is 0.004% or less. The S content is preferably 0.003% or less, more preferably 0.002% or less. The lower limit of S content is not particularly limited. However, the preferred lower limit of S content is about 0.0004% because excessive desulfurization leads to increase of manufacturing cost.

Al: 0.010 to 0.100%

Al is an element that acts as a deoxidizing agent. An Al content of 0.010% or more is needed to reduce solid solution oxygen, and prevent decrease of the effective amount of Cr due to chromium oxide formation. For this reason, the Al content is 0.010% or more. The Al content is preferably 0.015% or more, more preferably 0.020% or more. An Al content of more than 0.100% results in producing large amounts of $Al_2O_3$ in the steel, and has adverse effects on high-temperature hot ductility of steel. For this reason, the upper limit of Al content is 0.100%. The Al content is preferably 0.080% or less, more preferably 0.040% or less.

Cu: 0.03 to 0.80%

Cu is an element that is effective at preventing steel corrosion in a sulfuric acid dew-point environment. Cu also acts to improve the exfoliation of corrosion products when enriched in the outer surface of the steel pipe with Cr. A Cu content of 0.03% or more is needed to obtain such an effect. For this reason, the Cu content is 0.03% or more. The Cu content is preferably 0.10% or more, more preferably 0.20% or more. It is well known that Cu decreases the high-temperature ductility of steel, and, accordingly, the upper limit of Cu content is 0.80% because a Cu content of more than 0.80% results in producing notable defects in outer surface during hot rolling. The Cu content is preferably 0.60% or less, more preferably 0.40% or less.

Ni: 0.02 to 0.50%

Ni is an element that inhibits decrease of high-temperature ductility of Cu when added to a Cu-containing steel. A Ni content of 0.02% or more is needed to obtain such an effect. For this reason, the Ni content is 0.02% or more. The Ni content is preferably 0.08% or more, more preferably 0.10% or more. The upper limit of Ni content is 0.50% because Ni is an expensive element to add, and the effect becomes saturated even when contained in an amount of more than 0.50%. The Ni content is preferably 0.45% or less, more preferably 0.30% or less.

Cr: 0.55 to 1.00%

Cr does not greatly contribute to preventing the corrosion itself in a sulfuric acid dew-point environment. However, as shown in FIG. 2, Cr is an important element that contributes to improving the exfoliation of corrosion products with Cu and Sb. A Cr content of 0.55% or more is needed to obtain such an effect. For this reason, the Cr content is 0.55% or more. The Cr content is preferably 0.57% or more, more preferably 0.60% or more. A Cr content of more than 1.00% promotes formation of internal defects at the time of piercing during hot rolling of a seamless steel pipe, particularly in a portion of steel pipe corresponding to the centerline segregation occurring in continuous casting. For this reason, the upper limit of Cr content is 1.00%. The Cr content is preferably 0.90% or less, more preferably 0.80% or less.

Sb: 0.005 to 0.20%

Sb, as is Cu, is an element that is effective at preventing steel corrosion in a sulfuric acid dew-point corrosive environment. Sb also acts to improve the exfoliation of corrosion products when enriched in the outer surface of a steel pipe with Cr. An Sb content of 0.005% or more is needed to obtain these effects. For this reason, the Sb content is 0.005% or more. The Sb content is preferably 0.02% or more, more preferably 0.05% or more. The upper limit of Sb content is 0.20% because an Sb content of more than 0.20% seriously decreases high-temperature ductility, and causes severe outer surface defects during hot rolling. The Sb content is preferably 0.15% or less, more preferably 0.09% or less.

In addition to the foregoing preferred basic components, aspects of the present invention may optionally contain one or both of W: 0.003 to 0.040% and Sn: 0.005 to 0.5%.

W: 0.003 to 0.040%

The present inventors found that W improves the exfoliation of corrosion products produced in a sulfuric acid dew-point environment, as does Cr. However, unlike Cr, W is an expensive element, and may be added with Cr for additional improvement of the exfoliation of corrosion products. A W content of 0.003% or more is needed to obtain such an effect. For this reason, W, when contained, is contained in an amount of 0.003% or more. The W content is preferably 0.005% or more, more preferably 0.008% or more. A W content of more than 0.040% promotes formation of internal defects at the time of piercing during hot rolling of a seamless steel pipe, particularly in a portion of steel pipe corresponding to the centerline segregation occurring in continuous casting. For this reason, the upper limit of W, when contained, is 0.040%. The W content is preferably 0.030% or less, more preferably 0.015% or less.

Sn: 0.005 to 0.5%

Sn has only limited effects for the improvement of the exfoliation of corrosion products produced in a sulfuric acid dew-point environment, as shown in FIG. 2. However, Sn may be added to reduce the corrosion itself produced in a sulfuric acid dew-point corrosive environment. A Sn content of 0.005% or more is needed to improve sulfuric acid dew-point corrosion. For this reason, Sn, when contained, is contained in an amount of 0.005% or more. The Sn content is preferably 0.02% or more. The upper limit of Sn, when contained, is 0.5% because Sn decreases the high-temperature ductility of steel, as does Sb. The Sn content is preferably 0.05% or less.

In the foregoing composition, the balance is Fe and incidental impurities. Specific examples of the incidental impurity elements include H, O, Co, As, Zr, Ag, Ta, and Pb. The acceptable upper limits of these incidental impurities are H: 0.0005%, O: 0.004%, Co: 0.001%, As: 0.006%, Zr: 0.0004%, Ag: 0.001%, Ta: 0.004%, and Pb: 0.005%.

The following describes the Cu, Cr, Sb, and W concentrations specified for a seamless steel pipe according to aspects of the present invention below the outer surface.

A seamless steel pipe according to aspects of the present invention satisfies the following formulae (1) and (2) when the average concentrations (mass %) of Cu, Cr, Sb, and W in a region 0.5 to 2.0 mm away from the outer surface of the seamless steel pipe toward the center of the wall thickness of the steel pipe are Cu*, Cr*, Sb*, and W*, respectively.

Formula (1) (without W)

$$1.7\times Cu^*+11\times Cr^*+3.8\times Sb^*\geq 13.5 \quad (1)$$

Formula (2) (with W)

$$1.7\times Cu^*+11\times Cr^*+3.8\times Sb^*+5.2\times W^*\geq 13.5 \quad (2)$$

As described above, aspects of the present invention are intended to solve the issue of exfoliation of corrosion products produced in a sulfuric acid dew-point environment, and the exfoliation is related to enrichment of Cu, Cr, Sb, and W at the steel pipe surface. As used herein, "steel pipe surface" refers to a region at most 2 mm away from the outer surface of steel pipe. The composition of a corrosion product appears to correspond to Cu, Cr, Sb, and W that dissolve out when corrosion occurs in this region of steel pipe in a sulfuric acid dew-point environment, and exfoliation should improve when these elements are enriched at the steel pipe surface. The present inventors obtained an EPMA assay sample from various steel pipes, and calculated the concentrations (mass %) of Cu, Cr, Sb, and W in an EPMA line analysis conducted for a region lying 2 mm away from the outer surface side of the steel pipe sample toward the center of the wall thickness of the steel pipe at an accelerating voltage of 20 kV and a beam current of 0.5 μA with a beam size of 10 μm. The concentrations were calculated using a standard curve created in advance from the characteristic X-ray intensity of each element. Specifically, the concentration (mass %) was measured for each of Cu, Cr, Sb, and W at 0.25-mm intervals in a region 0.5 to 2.0 mm away from the outer surface toward the center of the wall thickness of steel pipe, and the arithmetic mean value of the measured concentrations was determined as the average concentration of each element [Cu*, Cr*, Sb*, or W*] in mass %. The 0.5-mm region just below the outer surface of the steel pipe was excluded from the measurement region because an accurate line analysis cannot be expected from a region this close to the sample surface. Separately, a corrosion test specimen was taken from the same seamless steel pipe from which the EPMA assay sample was obtained, and the exfoliation rate of corrosion products in a sulfuric acid dew-point environment was calculated from the corrosion test specimen in the manner schematically represented in FIG. 1. The exfoliation rate of corrosion products was then plotted against values obtained after multiple regression of Cu*, Cr*, Sb*, W* by solving $1.7\times Cu^*+11\times Cr^*+3.8\times Sb^*$ in the case of steel pipes not containing W, and $1.7\times Cu^*+11\times Cr^*+3.8\times Sb^*+5.2\times W^*$ in the case of steel pipes containing W, as shown in FIG. 4.

As can be seen from FIG. 4, the value on the left-hand side of formula (1) needs to be 13.5 or more (without W) for the exfoliation rate of corrosion products to be 10% or less. The value on the left-hand side of formula (1) is preferably 14.0 or more, more preferably 15.0 or more. When the value on the left-hand side of formula (1) is 14.0 or more, the exfoliation rate of corrosion products can have a smaller value, for example, 8% or less. When the value calculated from formula (1) is 15.0 or more, the exfoliation rate of corrosion products can have an even smaller value, for example, 5% or less. Likewise, the value on the left-hand side of formula (2) needs to be 13.5 or more (with W) for the exfoliation rate of corrosion products to be 10% or less. The value on the left-hand side of formula (2) is preferably 14.0 or more, more preferably 15.0 or more. When the value on the left-hand side of formula (2) is 14.0 or more, the exfoliation rate of corrosion products can have a smaller value, for example, 8% or less. When the value calculated from formula (2) is 15.0 or more, the exfoliation rate of corrosion products can have an even smaller value, for example, 5% or less. These values can be achieved by making appropriate combinations of Cu, Cr, Sb, and W contents in the steel, and implementing optimum conditions for the steel pipe manufacturing method, specifically, for the billet rolling or cast-piece heat treatment performed after the continuous casting of steel, as will be described later.

A seamless steel pipe according to aspects of the present invention has a yield strength of 230 MPa or more, and a tensile strength of 380 MPa or more to ensure the strength sufficient for piping. The yield strength is preferably 250 MPa or more. The tensile strength is preferably 400 MPa or more. The yield strength and tensile strength can be measured by using the methods described in the Examples below.

A method for manufacturing a seamless steel pipe according to aspects of the present invention is described below.

In accordance with aspects of the present invention, the steelmaking process is not particularly limited. For example, a molten steel of the foregoing composition can be made using an ordinary steelmaking process such as by using, for example, a converter, an electric furnace, or a vacuum melting furnace. For cost considerations, the molten steel is cast preferably by continuous casting. The manufacturing conditions of the manufacturing process following continuous casting are different for continuous casting that continuously casts molten steel into a common cast piece having a rectangular cross section, such as a slab or a bloom, and for continuous casting that continuously casts molten steel directly into a cast piece having a circular cross section more suited for hot rolling into a seamless steel pipe. The cast piece having a rectangular cross section is a column that is substantially quadrangular in shape, whereas the cast piece having a circular cross section is substantially cylindrical in shape.

In the case of continuous casting into a cast piece having a rectangular cross section, the cast piece having a rectangular cross section is heated to a predetermined heating temperature, and hot rolled into a steel pipe material having a circular cross section. The heating temperature is as follows. In accordance with aspects of the present invention, temperatures such as the heating temperature, hot rolling temperature, normalizing temperature, and cooling stop temperature of a cast piece, a steel pipe material, and a steel pipe are surface temperatures of a cast piece, a steel pipe material, and a steel pipe (outer surface temperature in the case of a steel pipe), unless otherwise specifically stated, and can be measured with, for example, a radiation thermometer.

Heating Temperature: 1,000 to 1,200° C. Temperature Region

In order to form a steel pipe material of a circular cross section by rolling (billet rolling) a cast piece having a rectangular cross section, the cast piece needs to be hot rolled in a temperature region of the austenitic phase of steel. Aspects of the present invention are intended to inhibit the exfoliation of corrosion products produced in a sulfuric acid dew-point environment, and the seamless steel pipe after the steel pipe heat treatment described below needs to have Cu, Cr, Sb, and W enriched in the outer surface. The heating temperature of billet rolling affects the enrichment of these elements. Specifically, when the heating temperature of billet rolling is less than 1,000° C., it is not possible to sufficiently enrich these elements in the outer surface of the cast piece (cast-piece surface), and Cu, Cr, Sb, and W cannot have the required concentrations in the outer surface of the seamless steel pipe after the final steel pipe heat treatment. The cast piece of a rectangular cross section is therefore heated to a heating temperature in a temperature region of 1,000° C. or more before hot rolling. That is, the heating temperature at the start of hot rolling (billet rolling) is 1,000° C. or more. The heating temperature is preferably 1,050° C. or more, more preferably 1,100° C. or more. The upper limit of heating temperature is 1,200° C. This is because the enrichment of the foregoing alloy elements becomes saturated at about 1,180° C. or more, and increasing the heating temperature at the expense of high fuel cost is not economically advantageous. The heating temperature is preferably 1,190° C. or less, more preferably 1,180° C. or less.

Heating Time from 900° C. to Heating Temperature: At Least 1.5 Hours (Preferred Condition)

In order to more effectively enrich elements such as Cu, Cr, Sb, W in the outer surface of the seamless steel pipe, it is preferable to increase the heating time particularly above 900° C. Specifically, the enrichment of elements such as Cu, Cr, Sb, and W becomes more notable when the time length of heating from 900° C. to the target heating temperature of billet rolling is at least 1.5 hours, regardless of the heating temperature of billet rolling. It is therefore preferable that the time length of heating from 900° C. to the heating temperature of billet rolling be at least 1.5 hours. The heating time is more preferably at least 2.0 hours. The upper limit of heating time is 3.0 hours because the effect becomes saturated with a heating time longer than 3.0 hours, and increasing the heating time longer than 3.0 hours is not economically advantageous in terms of expenses such as fuel cost.

The cast piece of a rectangular cross section is hot rolled (billet rolling) immediately after being heated to the target heating temperature in the 1,000 to 1,200° C. temperature region, preferably within 60 seconds after heating. The hot rolling end temperature (billet-rolling end temperature) is not particularly limited. However, considering the rolling load on a rolling mill, the hot rolling temperature end temperature (billet-rolling end temperature) is preferably 800° C. or more, more preferably 900° C. or more.

The hot rolling (billet rolling) is followed by cooling to room temperature. As used herein, "room temperature" means 25° C. The cooling method is not particularly limited. Typically, cooling is achieved by air cooling with, for example, a cooling bed. However, cooling may be achieved by weak water cooling, in order to reduce the time to cool to room temperature, and to increase the number of rolled pipes per hour. As used herein, "air cooling" means natural cooling that takes place without the use of any cooling means. Typically, the average cooling rate of air cooling is 1° C./s or less.

In the case of continuous casting to a cast piece having a circular cross section, the cast piece is heated (cast-piece heat treatment) into a steel pipe material before rolled into a steel pipe (tubing). The heating temperature of the cast-piece heat treatment is as follows.

Heating Temperature of Cast-Piece Heat Treatment: 1,000 to 1,200° C. Temperature Region The cast-piece heat treatment adopts the same heating temperature as billet rolling to ensure the same effect. Specifically, when the heating temperature of cast-piece heat treatment is less than 1,000° C., it is not possible to sufficiently enrich elements such as Cu, Cr, Sb, and W in the outer surface of the cast piece (cast-piece surface), and Cu, Cr, Sb, and W cannot have the required concentrations in the outer surface of the seamless steel pipe after the final steel pipe heat treatment. The heating temperature of the cast-piece heat treatment is therefore 1,000° C. or more. The heating temperature is preferably 1,050° C. or more, more preferably 1,100° C. or more. The upper limit of the heating temperature of cast-piece heat treatment is 1,200° C. This is because the enrichment of the foregoing elements becomes saturated at about 1,180° C. or more, and increasing the heating temperature at the expense of high fuel cost is not economically advantageous. The heating temperature of cast-piece heat treatment is preferably 1,190° C. or less, more preferably 1,180° C. or less.

Heating Time from 900° C. to Heating Temperature: At Least 1.5 Hours (Preferred Condition)

In order to more effectively enrich elements such as Cu, Cr, Sb, W in the outer surface of the seamless steel pipe, it is preferable to increase the heating time particularly above 900° C. Specifically, the enrichment of elements such as Cu, Cr, Sb, and W becomes more notable when the time length of heating from 900° C. to the target heating temperature of cast-piece heat treatment is at least 1.5 hours, regardless of the heating temperature of cast-piece heat treatment. It is therefore preferable that the time length of heating from 900° C. to the heating temperature of cast-piece heat treatment be at least 1.5 hours. The heating time is more preferably at least 2.0 hours. The upper limit of heating time is 3.0 hours because the effect becomes saturated with a heating time longer than 3.0 hours, and increasing the heating time longer than 3.0 hours is not economically advantageous in terms of expenses such as fuel cost.

In the cast-piece heat treatment process, the cast piece having reached the target heating temperature is immediately taken out of the furnace, and cooled to room temperature. The cooling method after the cast-piece heat treatment is not particularly limited. Typically, cooling is achieved by air cooling with, for example, a cooling bed. However, cooling may be achieved by weak water cooling, in order to reduce the time to cool to room temperature, and to increase the number of heat treatment pipes per hour.

The steel pipe material after the billet rolling or cast-piece heat treatment is used to form a seamless steel pipe of a predetermined shape in a hot process (tubing process). In the tubing process, the steel pipe material may be formed into a seamless steel pipe of a predetermined shape by a process that hot rolls the preheated steel pipe material (piercing followed by mandrel mill rolling or plug mill rolling into a predetermined wall thickness, and rolling into an appropriately reduced diameter). The heating temperature and hot rolling temperature of the steel pipe material are as follows.

Steel Pipe Material Heating Temperature: 1,100 to 1,300° C.

In the tubing process, the steel pipe material is heated, and hot rolled into a seamless steel pipe of a predetermined shape. In order to prevent defects, the steel pipe material is heated to a heating temperature of 1,100° C. or more because a steel pipe material heating temperature of less than 1,100° C. causes severe internal defects during piercing, and defects detected in a nondestructive testing after the final steel pipe heat treatment cannot be removed even when the steel pipe is subjected to repair or finishing to make it acceptable. The steel pipe material heating temperature is preferably 1,150° C. or more, more preferably 1,200° C. or more. The upper limit of steel pipe material heating temperature is 1,300° C. because a steel pipe material heating temperature of more than 1,300° C. results in a loss of steel surface by oxidation, and increased fuel costs, among other economic disadvantages. The steel pipe material heating temperature is preferably 1,290° C. or less, more preferably 1,280° C. or less.

Hot Rolling Temperature: 800° C. or More

With a rolling temperature of hot rolling (steel pipe rolling) below 800° C., the high-temperature ductility of steel decreases, and defects occur in outer surface during hot rolling. The defects remain even after the steel pipe heat treatment, and defects detected in a nondestructive testing cannot be removed even when the steel pipe is subjected to repair or finishing to make it acceptable. From the perspective of preventing defects, the hot rolling temperature is 800° C. or more. That is, the hot rolling (steel pipe rolling) end temperature is 800° C. or more. For example, when the hot rolling is a process starting from piercing followed by mandrel mill rolling or plug mill rolling and ending with diameter reduction rolling, the rolling end temperature of diameter reduction rolling is 800° C. or more. The hot rolling temperature is preferably 830° C. or more, more preferably 850° C. or more.

The hot rolling of the steel pipe is followed by cooling to room temperature. The cooling method is not particularly limited. Typically, cooling is achieved by air cooling with, for example, a cooling bed. However, cooling may be achieved by weak water cooling, in order to reduce the time to cool to room temperature, and to increase the number of rolled pipes per hour.

The seamless steel pipe cooled to room temperature after the tubing process is subjected to a normalizing heat treatment (steel pipe heat treatment process). The purpose of the normalizing heat treatment is to adjust the hardness of the seamless steel pipe to a predetermined strength suited for piping. The heat treatment temperature (normalizing temperature) of the normalizing heat treatment is as follows.

Normalizing Temperature: 850 to 1,050° C.

When the normalizing temperature of normalizing heat treatment is less than 850° C., transformation into austenite does not proceed to completion in part of the steel, and untransformed ferrite and perlite persist in steel structure at high temperature. Because the ferrite and perlite structure causes decrease of steel strength, the normalizing temperature is 850° C. or more. The normalizing temperature is preferably 880° C. or more, more preferably 900° C. or more. With a normalizing temperature of more than 1,050° C., serious grain growth occurs after transformation into austenite, and coarse ferrite grains are formed by transformation in the course of cooling after the normalizing heat treatment, with the result that the yield strength decreases. For this reason, the normalizing temperature is 1,050° C. or less. The normalizing temperature is preferably 1,000° C. or less, more preferably 950° C. or less.

Preferably, the cooling after the normalizing heat treatment is air cooling with, for example, a cooling bed. When cooling is achieved by weak water cooling to increase the number of rolled pipes per hour, it is preferable to start the cooling process from 500° C. or less, a temperature sufficiently lower than the temperature at the end of transformation.

EXAMPLES

Molten steels of the compositions shown in Tables 1 and 2 were made by a method using a converter, and were each cast into a cast piece by continuous casting. In continuous casting, some steels were cast into cast pieces having a rectangular cross section (300 mm in thickness×400 mm in width) while the others were cast into cast pieces having a circular cross section (190 mm in diameter).

The cast piece having a rectangular cross section was heated at a predetermined heating temperature, and hot rolled into a steel pipe material (billet-rolled steel pipe material) measuring 190 mm or 140 mm in diameter. Seamless steel pipes made from such a steel pipe material are denoted as "Billet rolled" under the heading "Type of steel pipe material" in Tables 3, 4, and 5. The heating temperature, the heating time from 900° C. to heating temperature, and the billet-rolling end temperature of billet rolling are as shown in Tables 3, 4, and 5.

The cast piece having a circular cross section was prepared into a steel pipe material by cast-piece heat treatment, except for some comparative materials. Steel pipes produced from the steel pipe material obtained by cast-piece heat treatment are denoted as "Cast-piece heat treatment" under the heading "Type of steel pipe material" in Tables 3, 4, and 5. Seamless steel pipes produced for comparison without cast-piece heat treatment are denoted as "As-cast" under the heading "Type of steel pipe material" in Tables 3, 4, and 5. The heating temperature, and the heating time from 900° C. to heating temperature of cast-piece heat treatment are as shown in Tables 3, 4, and 5.

These steel pipe materials were used to form seamless steel pipes of the wall thicknesses and outer diameters shown in Tables 3, 4, and 5 (tubing process). Here, the steel pipe material was heated, and subjected to hot rolling in a process starting from piercing followed by mandrel mill rolling and ending with diameter reduction rolling. The heating temperature and hot rolling end temperature of steel pipe material, and the cooling conditions after hot rolling are as shown in Tables 3, 4, and 5. This was followed by a steel pipe heat treatment performed under the steel pipe heat treatment conditions shown in Tables 3, 4, and 5. After the steel pipe heat treatment, the steel pipe was allowed to cool to room temperature, and subjected to a nondestructive testing to check for defects in inner and outer surfaces of the steel pipe. The presence or absence of defects, and the success or failure of defect removal by repair are indicated under the heading "Pipe defect" in Tables 6, 7, and 8. The evaluation result is "Excellent" when there was no defect in a nondestructive testing, "Satisfactory" when defects were observed in a nondestructive testing but the required criteria were satisfied after repair, and "Fail" when defects were observed in a nondestructive testing, and repair was impossible or the required criteria were not satisfied even after repair. Steel pipes with "Excellent" or "Satisfactory" were regarded as having desirable manufacturability, with the former being more desirable. The term "repair" means removing scratch and other defects using, for example, a cutting device.

An EPMA assay sample, a tensile test specimen, and a corrosion test specimen for a corrosion test in a sulfuric acid dew-point environment were taken from the seamless steel pipe produced above.

An EPMA assay sample was prepared by taking a cross section orthogonal to the longitudinal direction of steel pipe to provide a measurement surface, and polishing the surface to a mirror finish. In EPMA, the sample was measured in a 2-mm region lying on the outer surface side of steel pipe toward the center of the wall thickness of steel pipe at an accelerating voltage of 20 kV and a beam current of 0.5 μA with a beam size of 10 μm. The measurement was made in a 2-mm region at the outer surface of steel pipe because the composition of corrosion products produced in a sulfuric acid dew-point environment corresponds to the concentrations of the alloy elements that dissolve out when corrosion occurs in this region of steel pipe in a sulfuric acid dew-point environment. The measurement was made for Cu, Cr, Sb, and W. Tungsten was measured only in steel Nos. R, S, T, V, W, and AM to which W was actively added. The concentration (mass %) was calculated using a standard curve created in advance from the characteristic X-ray intensity of each element. Specifically, the concentration (mass %) was measured for each of Cu, Cr, Sb, and W at seven locations in 0.25-mm intervals in a region 0.5 to 2.0 mm away from the outer surface toward the center of the wall thickness of steel pipe, and the arithmetic mean value of the measured concentrations was determined as the average concentration of each element [Cu*, Cr*, Sb*, or W*] in mass %. Cu*, Cr*, Sb*, and W* are presented in Tables 6, 7, and 8. The tables also show values on the left-hand side of formulae (1) and (2) calculated from Cu*, Cr*, Sb*, and W*. In accordance with aspects of the present invention, the acceptable range of the values is 13.5 or more, preferably 14.0 or more, more preferably 15.0 or more. The 0.5-mm region just below the outer surface of the steel pipe was excluded from the measurement region because an accurate line analysis cannot be expected from a region this close to the sample surface.

A tensile test specimen was taken from arbitrarily chosen longitudinal and circumferential locations of the steel pipe. Steel pipes with an outer diameter of less than 170 mm were prepared into test specimens according to JIS Z2241 12B, whereas steel pipes with an outer diameter of 170 mm or more were prepared into test specimens according to JIS Z2241 12C. The tensile test was conducted according to JIS 22241. The yield strength and tensile strength obtained in the tensile test are shown in Tables 6, 7, and 8. Steel pipes were determined as being acceptable when the yield strength was 230 MPa or more, and the tensile strength was 380 MPa or more. The yield strength is preferably 250 MPa or more, and the tensile strength is preferably 400 MPa or more.

For the corrosion test performed in a sulfuric acid dew-point environment, a corrosion test specimen (30 mm in length×20 mm in width×5 mm in thickness) including an outer surface of steel pipe was taken from the outer surface side of steel pipe, and a surface corresponding to the outer surface side of steel pipe was ground by 0.5 mm to remove unwanted components such as scale. The exfoliation of corrosion products produced in a sulfuric acid dew-point corrosion test was evaluated using the procedures schematically represented in FIG. 1. First, a sulfuric acid aqueous solution that had been adjusted to a concentration of 70 mass % was poured into a container, and a corrosion test specimen 1 was immersed in the solution after the solution was heated and maintained at 50° C. with an external thermostat bath. The specimen was immersed for 96 hours. After 96-hour immersion, the sulfuric acid aqueous solution was discharged from the container, and the corrosion test specimen 1 was dried, and carefully taken out of the container. On a table, the corrosion test specimen 1 was photographed with a digital camera 2 to capture an image of corrosion products produced on the specimen surface. The photograph was taken on the outer surface side of steel pipe from which the corrosion test specimen was prepared. After suitable image processing and analysis (using ImageJ software available from NIH), the area $S_I$ ($mm^2$) of corrosion products was calculated from the captured image. After calculation, a transparent adhesive film (Cellotape®, part number CT-24, 24 mm width, available from NICHIBAN) was attached to the captured surface of the corrosion test specimen 1, and the film was peeled to collect easily exfoliatable samples of corrosion products on the adhesive surface of the adhesive film. Images of the corrosion products on the adhesive surface of the adhesive film were captured with digital camera 2, and the area of the corrosion products attached to the adhesive surface of the adhesive film was calculated by image analysis to find the area $S_{II}$ ($mm^2$) of the corrosion products exfoliated from the corrosion test specimen 1. The percentage of the area ($S_{II}$) of the corrosion products exfoliated from the corrosion test specimen relative to the area ($S_I$) of the corrosion products occurring on the corrosion test specimen surface was then calculated as the exfoliation rate of corrosion products (%), as follows.

$$[(S_{II}/S_I)\times 100]$$

The results are presented in Tables 6, 7, and 8. Steel pipes were determined as being acceptable when the exfoliation rate of corrosion products was 10% or less. The exfoliation rate of corrosion products is preferably 8% or less, more preferably 5% or less.

TABLE 1

| Steel No. | Composition (%) | | | | | | | | | | | | Grouping |
|---|---|---|---|---|---|---|---|---|---|---|---|---|---|
| | C | Si | Mn | P | S | Al | Cu | Ni | Cr | Sb | W | Sn | |
| A | 0.038 | 0.22 | 1.12 | 0.011 | 0.002 | 0.021 | 0.38 | 0.29 | 0.64 | 0.09 | — | — | Compliant Example |
| B | 0.037 | 0.23 | 1.11 | 0.010 | 0.001 | 0.023 | 0.37 | 0.28 | 0.65 | 0.09 | — | — | Compliant Example |
| C | 0.022 | 0.58 | 1.28 | 0.009 | 0.002 | 0.039 | 0.22 | 0.13 | 0.79 | 0.06 | — | — | Compliant Example |
| D | 0.033 | 0.29 | 1.34 | 0.012 | 0.002 | 0.033 | 0.33 | 0.28 | 0.77 | 0.05 | — | — | Compliant Example |
| E | 0.051 | 0.44 | 1.39 | 0.014 | 0.002 | 0.036 | 0.40 | 0.24 | 0.59 | 0.09 | — | — | Compliant Example |
| F | 0.059 | 0.31 | 1.18 | 0.011 | 0.001 | 0.022 | 0.34 | 0.16 | 0.63 | 0.04 | — | — | Compliant Example |
| G | 0.027 | 0.58 | 1.19 | 0.012 | 0.002 | 0.021 | 0.18 | 0.22 | 0.70 | 0.08 | — | — | Compliant Example |
| H | 0.036 | 0.81 | 1.34 | 0.031 | 0.002 | 0.022 | 0.24 | 0.07 | 0.71 | 0.07 | — | — | Compliant Example |
| I | 0.024 | 0.20 | 1.28 | 0.012 | 0.004 | 0.017 | 0.36 | 0.19 | 0.69 | 0.01 | — | — | Compliant Example |
| J | 0.038 | 0.11 | 1.02 | 0.013 | 0.002 | 0.020 | 0.36 | 0.28 | 0.71 | 0.08 | — | — | Compliant Example |
| K | 0.034 | 0.47 | 1.13 | 0.011 | 0.001 | 0.021 | 0.40 | 0.30 | 0.62 | 0.09 | — | — | Compliant Example |
| L | 0.021 | 0.21 | 1.46 | 0.014 | 0.002 | 0.022 | 0.44 | 0.29 | 0.61 | 0.08 | — | — | Compliant Example |
| M | 0.035 | 0.62 | 1.24 | 0.013 | 0.002 | 0.037 | 0.39 | 0.25 | 0.88 | 0.05 | — | — | Compliant Example |
| N | 0.040 | 0.33 | 1.32 | 0.012 | 0.003 | 0.051 | 0.28 | 0.14 | 0.66 | 0.10 | — | — | Compliant Example |
| O | 0.112 | 0.04 | 0.39 | 0.014 | 0.002 | 0.023 | 0.04 | 0.04 | 0.91 | 0.16 | — | — | Compliant Example |
| P | 0.100 | 0.03 | 1.86 | 0.017 | 0.001 | 0.012 | 0.65 | 0.48 | 0.62 | 0.08 | — | — | Compliant Example |
| R | 0.020 | 0.24 | 1.38 | 0.009 | 0.001 | 0.023 | 0.23 | 0.22 | 0.78 | 0.06 | 0.014 | — | Compliant Example |
| S | 0.023 | 0.23 | 1.36 | 0.008 | 0.001 | 0.022 | 0.26 | 0.25 | 0.77 | 0.07 | 0.009 | — | Compliant Example |
| T | 0.054 | 0.49 | 1.14 | 0.010 | 0.002 | 0.024 | 0.39 | 0.37 | 0.64 | 0.06 | 0.024 | — | Compliant Example |
| U | 0.022 | 0.23 | 1.35 | 0.008 | 0.001 | 0.023 | 0.26 | 0.24 | 0.69 | 0.09 | — | 0.04 | Compliant Example |
| V | 0.039 | 0.23 | 1.27 | 0.012 | 0.002 | 0.040 | 0.35 | 0.36 | 0.64 | 0.07 | 0.011 | 0.09 | Compliant Example |
| W | 0.024 | 0.22 | 1.37 | 0.008 | 0.002 | 0.022 | 0.24 | 0.23 | 0.71 | 0.05 | 0.013 | 0.02 | Compliant Example |

TABLE 2

| Steel No. | Composition (%) | | | | | | | | | | | | Grouping |
|---|---|---|---|---|---|---|---|---|---|---|---|---|---|
| | C | Si | Mn | P | S | Al | Cu | Ni | Cr | Sb | W | Sn | |
| X | 0.130 | 0.21 | 1.15 | 0.013 | 0.002 | 0.023 | 0.39 | 0.38 | 0.61 | 0.08 | — | — | Comparative Example |
| Y | 0.010 | 0.22 | 1.94 | 0.012 | 0.002 | 0.022 | 0.38 | 0.37 | 0.62 | 0.09 | — | — | Comparative Example |
| Z | 0.037 | 1.06 | 1.17 | 0.012 | 0.002 | 0.024 | 0.37 | 0.36 | 0.61 | 0.08 | — | — | Comparative Example |
| AA | 0.089 | 0.005 | 1.14 | 0.013 | 0.002 | 0.023 | 0.38 | 0.37 | 0.63 | 0.07 | — | — | Comparative Example |
| AB | 0.035 | 0.23 | 2.07 | 0.011 | 0.001 | 0.022 | 0.38 | 0.38 | 0.62 | 0.08 | — | — | Comparative Example |
| AC | 0.040 | 0.67 | 0.04 | 0.014 | 0.001 | 0.023 | 0.39 | 0.37 | 0.62 | 0.08 | — | — | Comparative Example |
| AD | 0.035 | 0.22 | 1.16 | 0.058 | 0.002 | 0.021 | 0.38 | 0.39 | 0.63 | 0.09 | — | — | Comparative Example |
| AE | 0.034 | 0.23 | 1.16 | 0.012 | 0.005 | 0.024 | 0.37 | 0.36 | 0.61 | 0.08 | — | — | Comparative Example |
| AF | 0.037 | 0.21 | 1.15 | 0.013 | 0.002 | 0.024 | 0.86 | 0.49 | 0.62 | 0.08 | — | — | Comparative Example |
| AG | 0.036 | 0.24 | 1.14 | 0.012 | 0.001 | 0.023 | 0.01 | 0.38 | 0.64 | 0.07 | — | — | Comparative Example |

TABLE 2-continued

| Steel No. | Composition (%) C | Si | Mn | P | S | Al | Cu | Ni | Cr | Sb | W | Sn | Grouping |
|---|---|---|---|---|---|---|---|---|---|---|---|---|---|
| AH | 0.035 | 0.23 | 1.17 | 0.012 | 0.001 | 0.022 | 0.38 | 0.01 | 0.61 | 0.08 | — | — | Comparative Example |
| AI | 0.036 | 0.21 | 1.16 | 0.011 | 0.001 | 0.024 | 0.37 | 0.36 | 1.09 | 0.07 | — | — | Comparative Example |
| AJ | 0.035 | 0.22 | 1.17 | 0.014 | 0.002 | 0.023 | 0.79 | 0.49 | 0.51 | 0.09 | — | — | Comparative Example |
| AK | 0.037 | 0.23 | 1.17 | 0.013 | 0.001 | 0.021 | 0.36 | 0.38 | 0.62 | 0.22 | — | — | Comparative Example |
| AL | 0.034 | 0.21 | 1.16 | 0.012 | 0.001 | 0.022 | 0.56 | 0.37 | 0.58 | 0.003 | — | — | Comparative Example |
| AM | 0.036 | 0.24 | 1.15 | 0.013 | 0.001 | 0.022 | 0.39 | 0.36 | 0.61 | 0.08 | 0.051 | — | Comparative Example |
| AN | 0.036 | 0.22 | 1.13 | 0.012 | 0.002 | 0.023 | 0.38 | 0.38 | 0.62 | 0.08 | — | 0.60 | Comparative Example |

Underline means outside of the range of the present invention.

TABLE 3

| Steel Pipe No. | Steel No. | Type of steel pipe material | Heating temp. of billet rolling (° C.) | Heating temp. of cast-piece heat treatment (° C.) | Heating time from 900° C. to heating temp. of billet rolling or cast-piece heat treatment (hr) | Billet rolling end temp. (° C.) | Wall thick-ness (mm) |
|---|---|---|---|---|---|---|---|
| 1-1 | A | Billet rolled | 1177 | — | 2.2 | 1025 | 12.7 |
| 1-2 | B | Cast-piece heat treatment | — | 1175 | 2.5 | — (Cast-piece heat treatment) | 12.7 |
| 1-3 | C | Billet rolled | 1133 | — | 2.0 | 924 | 8.0 |
| 1-4 | D | Billet rolled | 1138 | — | 2.1 | 933 | 8.0 |
| 1-5 | E | Billet rolled | 1089 | — | 1.5 | 918 | 8.0 |
| 1-6 | F | Billet rolled | 1156 | — | 1.8 | 1031 | 12.7 |
| 1-7 | G | Billet rolled | 1132 | — | 0.9 | 911 | 12.7 |
| 1-8 | H | Billet rolled | 1134 | — | 0.8 | 908 | 8.0 |
| 1-9 | I | Billet rolled | 1078 | — | 0.5 | 903 | 8.0 |
| 1-10 | J | Billet rolled | 1198 | — | 0.7 | 1092 | 8.0 |
| 1-11 | K | Cast-piece heat treatment | — | 1149 | 2.2 | — (Cast-piece heat treatment) | 10.6 |
| 1-12 | L | Cast-piece heat treatment | — | 1151 | 2.1 | — (Cast-piece heat treatment) | 10.6 |
| 1-13 | M | Cast-piece heat treatment | — | 1148 | 2.0 | — (Cast-piece heat treatment) | 12.7 |
| 1-14 | N | Cast-piece heat treatment | — | 1153 | 2.1 | — (Cast-piece heat treatment) | 12.7 |
| 1-15 | O | Cast-piece heat treatment | — | 1094 | 0.7 | — (Cast-piece heat treatment) | 10.6 |
| 1-16 | P | Cast-piece heat treatment | — | 1146 | 0.6 | — (Cast-piece heat treatment) | 12.7 |
| 1-17 | R | Billet rolled | 1141 | — | 2.2 | 909 | 8.0 |
| 1-18 | S | Cast-piece heat treatment | — | 1166 | 2.2 | — (Cast-piece heat treatment) | 10.6 |
| 1-19 | T | Cast-piece heat treatment | — | 1075 | 0.8 | — (Cast-piece heat treatment) | 10.6 |
| 1-20 | U | Billet rolled | 1148 | — | 2.0 | 913 | 8.0 |
| 1-21 | V | Cast-piece heat treatment | — | 1172 | 2.1 | — (Cast-piece heat treatment) | 10.6 |
| 1-22 | W | Billet rolled | 1144 | — | 2.1 | 921 | 12.7 |

| Steel Pipe No. | Outer diameter (mm) | Tubing conditions: Heating temp. (° C.) | Hot rolling end temp. (° C.) | Post-rolling cooling | Steel pipe heat treatment conditions: Normalizing temp. (° C.) | Post-normalization cooling | Grouping |
|---|---|---|---|---|---|---|---|
| 1-1 | 177.8 | 1275 | 880 | Air cooling | 920 | Air cooling | Compliant Example |
| 1-2 | 177.8 | 1270 | 885 | Air cooling | 930 | Air cooling | Compliant Example |
| 1-3 | 50.8 | 1249 | 861 | Air cooling | 945 | Air cooling | Compliant Example |
| 1-4 | 50.8 | 1252 | 873 | Air cooling | 940 | Air cooling | Compliant Example |

TABLE 3-continued

| | | | | | | | |
|---|---|---|---|---|---|---|---|
| 1-5 | 50.8 | 1254 | 866 | Air cooling | 965 | Air cooling | Compliant Example |
| 1-6 | 177.8 | 1273 | 877 | Air cooling | 1003 | Air cooling | Compliant Example |
| 1-7 | 177.8 | 1276 | 882 | Air cooling | 970 | Air cooling | Compliant Example |
| 1-8 | 50.8 | 1166 | 837 | Air cooling | 955 | Air cooling | Compliant Example |
| 1-9 | 50.8 | 1183 | 832 | Air cooling | 950 | Air cooling | Compliant Example |
| 1-10 | 50.8 | 1219 | 844 | Air cooling | 955 | Air cooling | Compliant Example |
| 1-11 | 138.9 | 1229 | 864 | Air cooling | 935 | Air cooling | Compliant Example |
| 1-12 | 138.9 | 1231 | 847 | Air cooling | 915 | Air cooling | Compliant Example |
| 1-13 | 177.8 | 1189 | 838 | Air cooling | 890 | Air cooling | Compliant Example |
| 1-14 | 177.8 | 1192 | 850 | Air cooling | 875 | Air cooling | Compliant Example |
| 1-15 | 138.9 | 1128 | 835 | Air cooling | 930 | Air cooling | Compliant Example |
| 1-16 | 177.8 | 1291 | 1001 | Air cooling | 945 | Air cooling | Compliant Example |
| 1-17 | 50.8 | 1249 | 863 | Air cooling | 930 | Air cooling | Compliant Example |
| 1-18 | 138.9 | 1245 | 871 | Air cooling | 940 | Air cooling | Compliant Example |
| 1-19 | 138.9 | 1249 | 866 | Air cooling | 935 | Air cooling | Compliant Example |
| 1-20 | 50.8 | 1228 | 859 | Air cooling | 945 | Air cooling | Compliant Example |
| 1-21 | 138.9 | 1246 | 866 | Air cooling | 940 | Air cooling | Compliant Example |
| 1-22 | 177.8 | 1233 | 862 | Air cooling | 940 | Air cooling | Compliant Example |

Underline means outside of the range of the present invention.

TABLE 4

| Steel pipe No. | Steel No. | Type of steel pipe material | Heating temp. of billet rolling (° C.) | Heating time from 900° C. to heating temp of billet rolling (hr) | Billet rolling end temp. (° C.) | Wall thickness (mm) | Outer diameter (mm) |
|---|---|---|---|---|---|---|---|
| 1-24 | X | Billet rolled | 1147 | 1.9 | 922 | 8.0 | 50.8 |
| 1-25 | Y | Billet rolled | 1145 | 1.8 | 923 | 8.0 | 50.8 |
| 1-26 | Z | Billet rolled | 1143 | 1.8 | 925 | 8.0 | 50.8 |
| 1-27 | AA | Billet rolled | 1148 | 1.7 | 926 | 8.0 | 50.8 |
| 1-28 | AB | Billet rolled | 1142 | 1.8 | 924 | 8.0 | 50.8 |
| 1-29 | AC | Billet rolled | 1147 | 1.7 | 923 | 8.0 | 50.8 |
| 1-30 | AD | Billet rolled | 1146 | 1.8 | 929 | 8.0 | 50.8 |
| 1-31 | AE | Billet rolled | 1144 | 2.0 | 932 | 8.0 | 50.8 |
| 1-32 | AF | Billet rolled | 1145 | 1.9 | 929 | 8.0 | 50.8 |
| 1-33 | AG | Billet rolled | 1141 | 2.0 | 926 | 8.0 | 50.8 |
| 1-34 | AH | Billet rolled | 1143 | 1.7 | 922 | 8.0 | 50.8 |
| 1-35 | AI | Billet rolled | 1144 | 1.8 | 931 | 8.0 | 50.8 |
| 1-36 | AJ | Billet rolled | 1151 | 2.1 | 939 | 8.0 | 50.8 |
| 1-37 | AK | Billet rolled | 1142 | 1.8 | 925 | 8.0 | 50.8 |
| 1-38 | AL | Billet rolled | 1154 | 2.2 | 943 | 8.0 | 50.8 |
| 1-39 | AM | Billet rolled | 1148 | 1.9 | 933 | 8.0 | 50.8 |
| 1-40 | AN | Billet rolled | 1152 | 1.8 | 927 | 8.0 | 50.8 |

| | Tubing conditions | | | Steel pipe heat treatment conditions | | |
|---|---|---|---|---|---|---|
| Steel pipe No. | Heating temp. (° C.) | Hot rolling end temp. (° C.) | Post-rolling cooling | Normalizing temp. (° C.) | Post-normalization cooling | Grouping |
| 1-24 | 1235 | 861 | Air cooling | 935 | Air cooling | Comparative Example |
| 1-25 | 1234 | 859 | Air cooling | 950 | Air cooling | Comparative Example |
| 1-26 | 1231 | 854 | Air cooling | 945 | Air cooling | Comparative Example |

TABLE 4-continued

| | | | | | | |
|---|---|---|---|---|---|---|
| 1-27 | 1236 | 859 | Air cooling | 940 | Air cooling | Comparative Example |
| 1-28 | 1233 | 856 | Air cooling | 935 | Air cooling | Comparative Example |
| 1-29 | 1238 | 866 | Air cooling | 950 | Air cooling | Comparative Example |
| 1-30 | 1232 | 853 | Air cooling | 940 | Air cooling | Comparative Example |
| 1-31 | 1236 | 863 | Air cooling | 935 | Air cooling | Comparative Example |
| 1-32 | 1235 | 862 | Air cooling | 945 | Air cooling | Comparative Example |
| 1-33 | 1232 | 859 | Air cooling | 940 | Air cooling | Comparative Example |
| 1-34 | 1239 | 867 | Air cooling | 935 | Air cooling | Comparative Example |
| 1-35 | 1233 | 854 | Air cooling | 935 | Air cooling | Comparative Example |
| 1-36 | 1236 | 864 | Air cooling | 940 | Air cooling | Comparative Example |
| 1-37 | 1234 | 857 | Air cooling | 940 | Air cooling | Comparative Example |
| 1-38 | 1238 | 868 | Air cooling | 935 | Air cooling | Comparative Example |
| 1-39 | 1237 | 865 | Air cooling | 935 | Air cooling | Comparative Example |
| 1-40 | 1235 | 853 | Air cooling | 940 | Air cooling | Comparative Example |

Underline means outside of the range of the present invention.

TABLE 5

| Steel pipe No. | Steel No. | Type of steel pipe material | Heating temp. of billet rolling (° C.) | Heating temp. of cast-piece heat treatment | Heating time from 900° C. to heating temp. of billet rolling or cast-piece heat treatment (hr) | Billet rolling end temp. (° C.) | Wall thickness (mm) | Outer diameter (mm) |
|---|---|---|---|---|---|---|---|---|
| 2-1 | A | Billet rolled | 980 | — | 0.3 | 844 | 12.7 | 177.8 |
| 2-2 | A | Billet rolled | 1181 | — | 1.6 | 1018 | 12.7 | 177.8 |
| 2-3 | A | Billet rolled | 1174 | — | 1.8 | 1031 | 12.7 | 177.8 |
| 2-4 | B | As-cast | — | No heat treatment | (No heat treatment) | — | 10.6 | 138.9 |
| 2-5 | B | Cast-piece heat treatment | — | 988 | 0.4 | — (Cast-piece heat treatment) | 10.6 | 138.9 |
| 2-6 | B | Cast-piece heat treatment | — | 1124 | 1.6 | — (Cast-piece heat treatment) | 10.6 | 138.9 |
| 2-7 | B | Cast-piece heat treatment | — | 1126 | 1.6 | — (Cast-piece heat treatment) | 10.6 | 138.9 |
| 2-8 | R | Billet rolled | 984 | — | 0.5 | 801 | 8.0 | 50.8 |
| 2-9 | T | As-cast | — | No heat treatment | (No heat treatment) | — | 10.6 | 138.9 |
| 2-10 | U | Billet rolled | 976 | — | 0.3 | 804 | 8.0 | 50.8 |
| 2-11 | V | As-cast | — | No heat treatment | (No heat treatment) | — | 8.0 | 50.8 |

| Steel pipe No. | Tubing conditions: Heating temp. (° C.) | Tubing conditions: Hot rolling end temp. (° C.) | Tubing conditions: Post-rolling cooling | Steel pipe heat treatment conditions: Normalizing temp. (° C.) | Steel pipe heat treatment conditions: Post-normalization cooling | Grouping |
|---|---|---|---|---|---|---|
| 2-1 | 1274 | 883 | Air cooling | 955 | Air cooling | Comparative Example |
| 2-2 | 1263 | 881 | Air cooling | 1055 | Air cooling | Comparative Example |
| 2-3 | 1203 | 857 | Air cooling | 840 | Air cooling | Comparative Example |
| 2-4 | 1230 | 861 | Air cooling | 940 | Air cooling | Comparative Example |
| 2-5 | 1228 | 858 | Air cooling | 935 | Air cooling | Comparative Example |
| 2-6 | 1233 | 862 | Air cooling | 1060 | Air cooling | Comparative Example |

TABLE 5-continued

| | | | | | | |
|---|---|---|---|---|---|---|
| 2-7 | 1231 | 863 | Air cooling | 835 | Air cooling | Comparative Example |
| 2-8 | 1255 | 869 | Air cooling | 940 | Air cooling | Comparative Example |
| 2-9 | 1251 | 856 | Air cooling | 930 | Air cooling | Comparative Example |
| 2-10 | 1231 | 847 | Air cooling | 940 | Air cooling | Comparative Example |
| 2-11 | 1241 | 854 | Air cooling | 935 | Air cooling | Comparative Example |

Underline means outside of the range of the present invention.

TABLE 6

| Steel pipe No. | Steel No. | Mean value of EPMA line analysis in 0.5 to 2.0-mm region below outer surface of steel pipe | | | | Value on left-hand side of formula (1) | Value on left-hand side of formula (2) |
|---|---|---|---|---|---|---|---|
| | | Cu* (mass %) | Cr* (mass %) | Sb* (mass %) | W* (mass %) | | |
| 1-1 | A | 0.68 | 1.20 | 0.17 | — | 15.0 | — |
| 1-2 | B | 0.68 | 1.26 | 0.17 | — | 15.7 | — |
| 1-3 | C | 0.39 | 1.46 | 0.12 | — | 17.2 | — |
| 1-4 | D | 0.59 | 1.39 | 0.09 | — | 16.6 | — |
| 1-5 | E | 0.72 | 1.11 | 0.18 | — | 14.1 | — |
| 1-6 | F | 0.60 | 1.18 | 0.08 | — | 14.3 | — |
| 1-7 | G | 0.24 | 1.16 | 0.11 | — | 13.6 | — |
| 1-8 | H | 0.34 | 1.16 | 0.09 | — | 13.7 | — |
| 1-9 | I | 0.52 | 1.15 | 0.02 | — | 13.6 | — |
| 1-10 | J | 0.47 | 1.16 | 0.11 | — | 14.0 | — |
| 1-11 | K | 0.73 | 1.20 | 0.17 | — | 15.1 | — |
| 1-12 | L | 0.82 | 1.20 | 0.16 | — | 15.2 | — |
| 1-13 | M | 0.68 | 1.63 | 0.09 | — | 19.4 | — |
| 1-14 | N | 0.52 | 1.28 | 0.19 | — | 15.7 | — |
| 1-15 | O | 0.07 | 1.13 | 0.26 | — | 13.5 | — |
| 1-16 | P | 1.12 | 1.03 | 0.13 | — | 13.7 | — |
| 1-17 | R | 0.40 | 1.44 | 0.12 | 0.03 | — | 17.1 |
| 1-18 | S | 0.48 | 1.48 | 0.14 | 0.02 | — | 17.7 |
| 1-19 | T | 0.68 | 1.08 | 0.12 | 0.03 | — | 13.6 |
| 1-20 | U | 0.46 | 1.28 | 0.18 | — | 15.5 | — |
| 1-21 | V | 0.64 | 1.22 | 0.13 | 0.02 | — | 15.1 |
| 1-22 | W | 0.42 | 1.31 | 0.10 | 0.02 | — | 15.6 |

| Steel pipe No. | Pipe defect | Tensile properties | | Exfoliation rate of corrosion product after 96-h immersion in 50° C., 70% sulfuric acid | Grouping |
|---|---|---|---|---|---|
| | | Yield strength (MPa) | Tensile strength (MPa) | | |
| 1-1 | Excellent | 266 | 401 | 5 | Present Example |
| 1-2 | Excellent | 269 | 403 | 4 | Present Example |
| 1-3 | Excellent | 254 | 387 | 2 | Present Example |
| 1-4 | Excellent | 263 | 411 | 3 | Present Example |
| 1-5 | Excellent | 278 | 545 | 8 | Present Example |
| 1-6 | Excellent | 244 | 561 | 7 | Present Example |
| 1-7 | Excellent | 237 | 404 | 10 | Present Example |
| 1-8 | Satisfactory | 266 | 444 | 9 | Present Example |
| 1-9 | Satisfactory | 256 | 392 | 10 | Present Example |
| 1-10 | Satisfactory | 271 | 428 | 8 | Present Example |
| 1-11 | Excellent | 261 | 407 | 4 | Present Example |
| 1-12 | Satisfactory | 248 | 424 | 5 | Present Example |
| 1-13 | Satisfactory | 237 | 389 | 2 | Present Example |
| 1-14 | Satisfactory | 235 | 392 | 4 | Present Example |
| 1-15 | Satisfactory | 306 | 513 | 10 | Present Example |
| 1-16 | Satisfactory | 311 | 574 | 9 | Present Example |
| 1-17 | Excellent | 253 | 422 | 3 | Present Example |
| 1-18 | Excellent | 275 | 418 | 2 | Present Example |
| 1-19 | Satisfactory | 296 | 535 | 9 | Present Example |
| 1-20 | Satisfactory | 279 | 434 | 4 | Present Example |
| 1-21 | Satisfactory | 268 | 422 | 4 | Present Example |
| 1-22 | Satisfactory | 259 | 433 | 2 | Present Example |

Underline means outside of the range of the present invention.

TABLE 7

| Steel pipe No. | Steel No. | Mean value of EPMA line analysis in 0.5 to 2.0-mm region below outer surface of steel pipe | | | | Value on left-hand side of formula (1) |
|---|---|---|---|---|---|---|
| | | Cu* (mass %) | Cr* (mass %) | Sb* (mass %) | W* (mass %) | |
| 1-24 | X | 0.68 | 1.13 | 0.16 | — | 14.2 |
| 1-25 | Y | 0.67 | 1.15 | 0.18 | — | 14.5 |
| 1-26 | Z | 0.65 | 1.13 | 0.16 | — | 14.1 |
| 1-27 | AA | 0.67 | 1.17 | 0.14 | — | 14.5 |
| 1-28 | AB | 0.67 | 1.15 | 0.16 | — | 14.4 |
| 1-29 | AC | 0.68 | 1.15 | 0.16 | — | 14.4 |
| 1-30 | AD | 0.67 | 1.17 | 0.18 | — | 14.7 |
| 1-31 | AE | 0.65 | 1.13 | 0.16 | — | 14.1 |
| 1-32 | AF | 1.51 | 1.15 | 0.16 | — | 15.8 |
| 1-33 | AG | 0.02 | 1.18 | 0.14 | — | 13.5 |
| 1-34 | AH | 0.67 | 1.13 | 0.16 | — | 14.2 |
| 1-35 | AI | 0.65 | 2.02 | 0.14 | — | 23.9 |
| 1-36 | AJ | 1.44 | 0.94 | 0.18 | — | 13.5 |
| 1-37 | AK | 0.63 | 1.15 | 0.44 | — | 15.4 |
| 1-38 | AL | 0.98 | 1.07 | 0.01 | — | 13.5 |
| 1-39 | AM | 0.68 | 1.13 | 0.16 | 0.08 | — |
| 1-40 | AN | 0.67 | 1.15 | 0.16 | — | 14.4 |

| Steel pipe No. | Value on left-hand side of formula (2) | Pipe defect | Tensile properties | | Exfoliation rate of corrosion product after 96-h immersion in 50° C., 70% sulfuric acid | Grouping |
|---|---|---|---|---|---|---|
| | | | Yield strength (MPa) | Tensile strength (MPa) | | |
| 1-24 | — | Fail | 322 | 641 | 7 | Comparative Example |
| 1-25 | — | Satisfactory | 207 | 344 | 8 | Comparative Example |
| 1-26 | — | Fail | 317 | 458 | 7 | Comparative Example |
| 1-27 | — | Satisfactory | 221 | 367 | 7 | Comparative Example |
| 1-28 | — | Fail | 281 | 562 | 8 | Comparative Example |
| 1-29 | — | Satisfactory | 215 | 372 | 8 | Comparative Example |
| 1-30 | — | Fail | 272 | 448 | 7 | Comparative Example |
| 1-31 | — | Fail | 266 | 427 | 8 | Comparative Example |
| 1-32 | — | Fail | 273 | 435 | 4 | Comparative Example |
| 1-33 | — | Excellent | 268 | 411 | 66 | Comparative Example |
| 1-34 | — | Fail | 262 | 408 | 8 | Comparative Example |
| 1-35 | — | Fail | 263 | 471 | 2 | Comparative Example |
| 1-36 | — | Excellent | 269 | 426 | 12 | Comparative Example |
| 1-37 | — | Fail | 278 | 449 | 4 | Comparative Example |
| 1-38 | — | Excellent | 263 | 408 | 72 | Comparative Example |
| 1-39 | 14.6 | Fail | 284 | 433 | 3 | Comparative Example |
| 1-40 | — | Fail | 257 | 398 | 8 | Comparative Example |

Underline means outside of the range of the present invention.

TABLE 8

| Steel pipe No. | Steel No. | Mean value of EPMA line analysis in 0.5 to 2.0-mm region below outer surface of steel pipe: Cu* (mass %) | Cr* (mass %) | Sb* (mass %) | W* (mass %) | Value on left-hand side of formula (1) |
|---|---|---|---|---|---|---|
| 2-1 | A | 0.39 | 0.63 | 0.10 | — | 8.0 |
| 2-2 | A | 0.68 | 1.19 | 0.17 | — | 14.9 |
| 2-3 | A | 0.66 | 1.22 | 0.18 | — | 15.2 |
| 2-4 | B | 0.39 | 0.66 | 0.09 | — | 8.3 |
| 2-5 | B | 0.41 | 0.73 | 0.12 | — | 9.2 |
| 2-6 | B | 0.67 | 1.24 | 0.16 | — | 15.4 |
| 2-7 | B | 0.69 | 1.25 | 0.18 | — | 15.6 |
| 2-8 | R | 0.24 | 0.79 | 0.07 | 0.01 | — |
| 2-9 | T | 0.40 | 0.65 | 0.06 | 0.02 | — |
| 2-10 | U | 0.27 | 0.69 | 0.10 | — | 8.4 |
| 2-11 | V | 0.36 | 0.64 | 0.08 | 0.01 | — |

| Steel pipe No. | Value on left-hand side of formula (2) | Pipe defect | Tensile properties: Yield strength (MPa) | Tensile strength (MPa) | Exfoliation rate of corrosion product after 96-h immersion in 50° C., 70% sulfuric acid | Grouping |
|---|---|---|---|---|---|---|
| 2-1 | — | Excellent | 267 | 402 | 23 | Comparative Example |
| 2-2 | — | Excellent | 214 | 394 | 7 | Comparative Example |
| 2-3 | — | Excellent | 221 | 367 | 5 | Comparative Example |
| 2-4 | — | Excellent | 272 | 403 | 29 | Comparative Example |
| 2-5 | — | Excellent | 268 | 398 | 19 | Comparative Example |
| 2-6 | — | Excellent | 211 | 392 | 5 | Comparative Example |
| 2-7 | — | Excellent | 217 | 372 | 4 | Comparative Example |
| 2-8 | 9.4 | Excellent | 255 | 417 | 17 | Comparative Example |
| 2-9 | 8.2 | Satisfactory | 292 | 531 | 18 | Comparative Example |
| 2-10 | — | Satisfactory | 282 | 433 | 34 | Comparative Example |
| 2-11 | 8.0 | Satisfactory | 272 | 419 | 21 | Comparative Example |

Underline means outside of the range of the present invention.

In present examples (steel pipe Nos. 1-1 to 1-22) in which the steel compositions and manufacturing conditions were within the ranges according to aspects of the present invention, and that satisfied the requirement for formula (1) or (2) according to aspects of the present invention, defects were not observed in inner and outer surfaces of the steel pipe. Even when present, the defects were minor, and the steel pipes had desirable manufacturability by satisfying the required criteria after repair. The steel pipes of the present examples also satisfied the yield strength and tensile strength required as seamless steel pipes for piping, and had desirable sulfuric acid dew-point corrosion resistance with an exfoliation rate of corrosion products of 10% or less observed after immersion in a sulfuric acid dew-point corrosive environment for 96 hours.

In contrast, defects were observed in the outer surface of the steel pipe in the nondestructive testing in comparative example (steel pipe No. 1-24) in which the C content in the steel exceeded the upper limit of the range of the present invention, comparative example (steel pipe No. 1-2 6) in which the Si content exceeded the upper limit of the range of the present invention, comparative example (steel pipe No. 1-32) in which the Cu content exceeded the upper limit of the range of the present invention, comparative example (steel pipe No. 1-37) in which the Sb content exceeded the upper limit of the range of the present invention, and comparative example (steel pipe No. 1-40) in which the Sn content exceeded the upper limit of the range of the present invention. In these comparative examples, the steel pipe did not have desired manufacturability by failing to satisfy the required criteria with the defects remaining even after repair.

Similarly, in comparative example (steel pipe No. 1-34) in which the Ni content in the steel was below the lower limit of the range of the present invention, defects were observed in the outer surface of the steel pipe in the nondestructive testing, and the steel pipe did not have desired manufacturability by failing to satisfy the required criteria with the defects remaining even after repair.

Defects were observed in the nondestructive testing after piercing in the rolling of the steel pipe in comparative example (steel pipe No. 1-28) in which the Mn content in the steel exceeded the upper limit of the range of the present invention, comparative example (steel pipe No. 1-30) in which the P content exceeded the upper limit of the range of the present invention, comparative example (steel pipe No. 1-31) in which the S content exceeded the upper limit of the range of the present invention, comparative example (steel pipe No. 1-35) in which the Cr content exceeded the upper limit of the range of the present invention, and comparative example (steel pipe No. 1-39) in which the W content exceeded the upper limit of the range of the present invention. The defects are probably due to the centerline segregation of the alloy elements exceeding the upper limits of the ranges of the present invention. In these comparative examples, the steel pipe did not have desired manufacturability by failing to satisfy the required criteria even after repair.

The yield strength and tensile strength failed to meet the target values in the tensile test in comparative example (steel pipe No. 1-25) in which the C content in the steel was below the lower limit of the range of the present invention, comparative example (steel pipe No. 1-27) in which the Si content was below the lower limit of the range of the present invention, and in comparative example (steel pipe No. 1-29) in which the Mn content was below the lower limit of the range of the present invention.

Severe corrosion occurred in the sulfuric acid dew-point corrosion test, and the steel pipe failed to satisfy the target exfoliation rate of corrosion products in comparative example (steel pipe No. 1-33) in which the Cu content in the steel was below the lower limit of the range of the present invention, and in comparative example (steel pipe No. 1-38) in which the Sb content was below the lower limit of the range of the present invention. In comparative example (steel pipe No. 1-36) in which the Cr content in the steel was below the lower limit of the range of the present invention, the steel pipe failed to satisfy the target exfoliation rate of corrosion products in the sulfuric acid dew-point corrosion test.

The steel pipe did not satisfy the requirement for formula (1) according to aspects of the present invention, and the exfoliation rate of corrosion products failed to meet the target value in the sulfuric acid dew-point corrosion test in comparative examples (steel pipe Nos. 2-1, 2-5, and 2-10) in which the steel composition satisfied the range according to aspects of the present invention but the heating temperature of the billet rolling or cast-piece heat treatment performed after continuous casting was below the lower limit of the range of the present invention. Similarly, the steel pipe did not satisfy the requirement for formula (2) according to aspects of the present invention, and the exfoliation rate of corrosion products failed to meet the target value in the sulfuric acid dew-point corrosion test in comparative example (steel pipe No. 2-8) in which the heating temperature of the billet rolling after continuous casting was below the lower limit of the range of the present invention.

The steel pipe did not satisfy the requirement for formula (1) or (2) according to aspects of the present invention, and the exfoliation rate of corrosion products failed to meet the target value in the sulfuric acid dew-point corrosion test in comparative example (steel pipe No. 2-4, 2-9, 2-11) in which the steel pipe was produced by the tubing and steel pipe heat treatment of as-cast steel pipe material without billet rolling or cast-piece heat treatment after continuous casting.

Coarsening of steel microstructure occurred in normalization, and the yield strength failed to achieve the target value in the tensile test in comparative examples (steel pipe Nos. 2-2 and 2-6) in which the normalizing temperature of the normalizing heat treatment of steel pipe exceeded the upper limit of the range of the present invention.

In comparative examples (steel pipe Nos. 2-3 and 2-7) in which the normalizing temperature of the normalizing heat treatment of steel pipe was below the lower limit of the range of the present invention, transformation into austenite did not occur over the whole surface in normalization, and untransformed ferrite and perlite partially remained at high temperature, with the result that the yield strength and tensile strength failed to achieve the target values in the tensile test.

REFERENCE SIGNS LIST

1 Test specimen
2 Digital camera

The invention claimed is:

1. A seamless steel pipe having desirable sulfuric acid dew-point corrosion resistance, the seamless steel pipe having a composition that consists of, in mass %, C: 0.02 to 0.12%, Si: 0.010 to 1.00%, Mn: 0.10 to 2.00%, P: 0.050% or less, S: 0.004% or less, Al: 0.010 to 0.100%, Cu: 0.03 to 0.80%, Ni: 0.02 to 0.50%, Cr: 0.55 to 1.00%, Sb: 0.005 to 0.20%, optionally Sn: 0.005 to 0.5%, and the balance Fe and incidental impurities, and satisfying the following formula (1), $$1.7\times Cu^*+11\times Cr^*+3.8\times Sb^*\geq 13.5 \quad \ldots (1),$$

where Cu*, Cr*, and Sb* represent average concentrations of Cu, Cr, and Sb, respectively, in mass %, as measured in a region 0.5 to 2.0 mm away from an outer surface of the steel pipe toward a center of a wall thickness of the steel pipe, the seamless steel pipe having a yield strength of 230 MPa or more, and a tensile strength of 380 MPa or more.

2. A seamless steel pipe having desirable sulfuric acid dew-point corrosion resistance, the seamless steel pipe having a composition that consists of, in mass %, C: 0.02 to 0.12%, Si: 0.010 to 1.00%, Mn: 0.10 to 2.00%, P: 0.050% or less, S: 0.004% or less, Al: 0.010 to 0.100%, Cu: 0.03 to 0.80%, Ni: 0.02 to 0.50%, Cr: 0.55 to 1.00%, Sb: 0.005 to 0.20%, W: 0.003 to 0.040%, optionally Sn: 0.005 to 0.5%, and the balance Fe and incidental impurities, and satisfying the following formula (2), $$1.7\times Cu^*+11\times Cr^*+3.8\times Sb^*+5.2\times W^*\geq 13.5 \quad \ldots (2),$$

where Cu*, Cr*, Sb*, and W* represent average concentrations of Cu, Cr, Sb, and W, respectively, in mass %, as measured in a region 0.5 to 2.0 mm away from an outer surface of the steel pipe toward a center of a wall thickness of the steel pipe, the seamless steel pipe having a yield strength of 230 MPa or more, and a tensile strength of 380 MPa or more.

3. The seamless steel pipe having desirable sulfuric acid dew-point corrosion resistance according to claim 1, wherein the composition comprises, in mass %, Sn: 0.005 to 0.5%.

4. The seamless steel pipe having desirable sulfuric acid dew-point corrosion resistance according to claim 2, wherein the composition comprises, in mass %, Sn: 0.005 to 0.5%.

5. A method for manufacturing the seamless steel pipe having desirable sulfuric acid dew-point corrosion resistance of claim 1, the method comprising:

casting a steel of said composition into a cast piece of a rectangular cross section;

heating the cast piece of a rectangular cross section to a heating temperature in a temperature region of 1,000 to 1,200° C., hot rolling the heated cast piece into a steel pipe material of a circular cross section, and cooling the steel pipe material;

heating the cooled steel pipe material to 1,100 to 1,300° C., hot rolling the heated steel pipe material at 800° C. or more into a seamless steel pipe of a predetermined shape, and cooling the seamless steel pipe; and heating the seamless steel pipe at a normalizing temperature of 850 to 1,050° C. in a normalizing heat treatment.

6. A method for manufacturing the seamless steel pipe having desirable sulfuric acid dew-point corrosion resistance of claim 2, the method comprising:

casting a steel of said composition into a cast piece of a rectangular cross section;

heating the cast piece of a rectangular cross section to a heating temperature in a temperature region of 1,000 to 1,200° C., hot rolling the heated cast piece into a steel pipe material of a circular cross section, and cooling the steel pipe material;

heating the cooled steel pipe material to 1,100 to 1,300° C., hot rolling the heated steel pipe material at 800° C. or more into a seamless steel pipe of a predetermined shape, and cooling the seamless steel pipe; and heating the seamless steel pipe at a normalizing temperature of 850 to 1,050° C. in a normalizing heat treatment.

7. The method according to claim 5, wherein the composition comprises, in mass %, Sn: 0.005 to 0.5%.

8. The method according to claim 6, wherein the composition comprises, in mass %, Sn: 0.005 to 0.5%.

9. The method according to claim 5, wherein the cast piece of a rectangular cross section is heated for at least 1.5 hours in a range of from 900° C. to the heating temperature in the temperature region of 1,000 to 1,200° C.

10. The method according to claim 6, wherein the cast piece of a rectangular cross section is heated for at least 1.5 hours in a range of from 900° C. to the heating temperature in the temperature region of 1,000 to 1,200° C.

11. The method according to claim 7, wherein the cast piece of a rectangular cross section is heated for at least 1.5 hours in a range of from 900° C. to the heating temperature in the temperature region of 1,000 to 1,200° C.

12. The method according to claim 8, wherein the cast piece of a rectangular cross section is heated for at least 1.5 hours in a range of from 900° C. to the heating temperature in the temperature region of 1,000 to 1,200° C.

13. A method for manufacturing the seamless steel pipe having desirable sulfuric acid dew-point corrosion resistance of claim 1, the method comprising:

casting a steel of said composition into a cast piece of a circular cross section;

heating the cast piece of a circular cross section to a heating temperature in a temperature region of 1,000 to 1,200° C. to obtain a steel pipe material, and cooling the steel pipe material;

heating the cooled steel pipe material to 1,100 to 1,300° C., hot rolling the heated steel pipe material at 800° C. or more into a seamless steel pipe of a predetermined shape, and cooling the seamless steel pipe; and heating the seamless steel pipe at a normalizing temperature of 850 to 1,050° C. in a normalizing heat treatment.

14. A method for manufacturing the seamless steel pipe having desirable sulfuric acid dew-point corrosion resistance of claim 2, the method comprising:

casting a steel of said composition into a cast piece of a circular cross section;

heating the cast piece of a circular cross section to a heating temperature in a temperature region of 1,000 to 1,200° C. to obtain a steel pipe material, and cooling the steel pipe material;

heating the cooled steel pipe material to 1,100 to 1,300° C., hot rolling the heated steel pipe material at 800° C. or more into a seamless steel pipe of a predetermined shape, and cooling the seamless steel pipe; and heating the seamless steel pipe at a normalizing temperature of 850 to 1,050° C. in a normalizing heat treatment.

15. The method according to claim 13, wherein the composition comprises, in mass %, Sn: 0.005 to 0.5%.

16. The method according to claim 14, wherein the composition comprises, in mass %, Sn: 0.005 to 0.5%.

17. The method according to claim 13, wherein the cast piece of a circular cross section is heated for at least 1.5 hours in a range of from 900° C. to the heating temperature in the temperature region of 1,000 to 1,200° C.

18. The method according to claim 14, wherein the cast piece of a circular cross section is heated for at least 1.5 hours in a range of from 900° C. to the heating temperature in the temperature region of 1,000 to 1,200° C.

19. The method according to claim 15, wherein the cast piece of a circular cross section is heated for at least 1.5 hours in a range of from 900° C. to the heating temperature in the temperature region of 1,000 to 1,200° C.

20. The method according to claim 16, wherein the cast piece of a circular cross section is heated for at least 1.5 hours in a range of from 900° C. to the heating temperature in the temperature region of 1,000 to 1,200° C.

* * * * *